US011367982B2

(12) United States Patent
Haga et al.

(10) Patent No.: US 11,367,982 B2
(45) Date of Patent: Jun. 21, 2022

(54) COAXIAL ELECTRICAL CONNECTOR AND METHODS OF MANUFACTURE THEREFOR

(71) Applicant: Hirose Electric Co., Ltd., Kanagawa (JP)

(72) Inventors: Yujin Haga, Kanagawa (JP); Masahiro Tsuchida, Kanagawa (JP); Tsubasa Kaneko, Kanagawa (JP)

(73) Assignee: Hirose Electric Co., Ltd., Kanagawa (JP)

( * ) Notice: Subject to any disclaimer, the term of this patent is extended or adjusted under 35 U.S.C. 154(b) by 0 days.

(21) Appl. No.: 17/172,421

(22) Filed: Feb. 10, 2021

(65) Prior Publication Data

US 2021/0249827 A1 Aug. 12, 2021

(51) Int. Cl.

| | |
|---|---|
| ***H01R 13/42*** | (2006.01) |
| ***H01R 103/00*** | (2006.01) |
| ***H01R 43/24*** | (2006.01) |
| ***H01R 24/40*** | (2011.01) |

(52) U.S. Cl.

CPC ..... *H01R 24/40* (2013.01); *H01R 13/42* (2013.01); *H01R 43/24* (2013.01); *H01R 2103/00* (2013.01)

(58) Field of Classification Search

CPC .... H01R 43/24; H01R 24/40; H01R 2103/00; H01R 13/42

See application file for complete search history.

(56) References Cited

U.S. PATENT DOCUMENTS

| | | | | |
|---|---|---|---|---|
| 6,902,408 | B2 * | 6/2005 | Yamane | H01R 24/50 439/581 |
| 8,047,871 | B2 * | 11/2011 | Kohnishi | H01R 9/0518 439/582 |
| 8,262,398 | B2 * | 9/2012 | Chen | H01R 24/50 439/188 |
| 8,721,347 | B2 * | 5/2014 | Xiao | H01R 24/50 439/63 |
| 9,203,196 | B2 * | 12/2015 | Hirakawa | H01R 24/50 |
| 9,343,854 | B2 * | 5/2016 | Nakamura | H01R 24/38 |
| 9,509,106 | B2 * | 11/2016 | Nakamura | H01R 24/50 |
| 10,158,200 | B2 * | 12/2018 | Miyazaki | H01R 12/75 |
| 10,164,384 | B2 * | 12/2018 | Maruyama | H05K 3/3405 |

(Continued)

FOREIGN PATENT DOCUMENTS

JP 2019-016460 A 1/2019

*Primary Examiner* — Briggitte R. Hammond
(74) *Attorney, Agent, or Firm* — Procopio, Cory, Hargreaves & Savitch LLP

(57) ABSTRACT

An inner conductor surrounded by an outer conductor in the circumferential direction of a tubular portion of the outer conductor throughout the entire circumference, an entire internal contact portion and a portion of a projecting portion are located within boundaries of the outer conductor in the up-down direction, a dielectric body with a bottom face aligned with the surface of the circuit board and which secures the bottom portion of the outer conductor and the projecting portion of the inner conductor, the outer edge of the tubular portion of a connecting portion of the inner conductor in the radial direction is located inside the tubular portion of the outer conductor in the radial direction, the bottom plate portion of the dielectric body has a passage portion that extends in the up-down direction, and the outer edge section of the connecting portion is positioned to protrude into the passage portion.

5 Claims, 12 Drawing Sheets

(56) References Cited

U.S. PATENT DOCUMENTS

| | | | | |
|---|---|---|---|---|
| 10,985,515 | B2 * | 4/2021 | Tanaka | H01R 24/44 |
| 2013/0115810 | A1 * | 5/2013 | Maruyama | H01R 24/50<br>439/578 |
| 2021/0249827 | A1 * | 8/2021 | Haga | H01R 13/42 |

* cited by examiner (A)

(B)

(C)

COAXIAL ELECTRICAL CONNECTOR AND METHODS OF MANUFACTURE THEREFOR

CROSS-REFERENCE TO RELATED APPLICATIONS

This application claims priority to Japanese Patent Application No. 2020-020414, filed Feb. 10, 2020, the contents of which are incorporated herein by reference in its entirety for all purposes.

BACKGROUND

Technical Field

The present disclosure relates to a coaxial electrical connector which is connected to a circuit board and into and from which a counterpart connector is plugged and unplugged such that the direction of plugging and unplugging is an up-down direction perpendicular to the surface of said circuit board.

Related Art Art

A well-known example of such a coaxial electrical connector is the coaxial connector disclosed in Patent Document 1. The coaxial connector of Patent Document 1 is mounted to a circuit board, and a counterpart connector is matingly connected thereto from above. Said coaxial connector includes an inner conductor (internal terminal) having a contact portion ("first conductor part" in Patent Document 1; the terms used in Patent Document 1 are shown in parentheses below) that extends in the up-down direction, an outer conductor (external terminal) that has a mating body portion (external conductor part) surrounding the contact portion about an axis extending in the up-down direction, and a dielectric body (first insulating member) that has a plate-like configuration parallel to the mounting face of the circuit board and secures the bottom end portion of the contact portion of the inner conductor and the bottom end portion of the mating body portion of the outer conductor in place via unitary co-molding.

The mating body portion of the outer conductor has a notched portion formed therein by cutting out a section thereof in the circumferential direction about said axis and has a substantially C-shaped configuration when viewed in the up-down direction. In addition to the contact portion, the inner conductor has a projecting portion (second conductor part) extending outward from the bottom end portion of said contact portion in a radial direction of the mating body portion toward the notched portion of said mating body portion. Said projecting portion, which is located inside the mating body portion in the radial direction, is adapted to be connected to the mounting face of the circuit board on the bottom face of said projecting portion.

The coaxial connector of Patent Document 1 is manufactured in accordance with the following procedure. First, a carrier-equipped inner conductor is provided, in which a carrier extends from the distal end of the projecting portion of the inner conductor in the radial direction outwardly beyond the mating body portion, and the contact portion of said carrier-equipped inner conductor is positioned in the center of the mating body portion of the outer conductor. In this state, the carrier extends through the notched portion of the mating body portion beyond said mating body portion in the radial direction as described above. Next, the projecting portion and the bottom end portion of the contact portion of the inner conductor as well as the bottom end portion of the mating body portion of the outer conductor are secured in place by the dielectric body via unitary co-molding. At such time, a space is formed in the dielectric body in a section extending from the distal end of the projecting portion, i.e., in the range wherein the carrier extends through the notched portion in the radial direction. In other words, said carrier is not secured in place by the dielectric body. The manufacture of the coaxial connector is subsequently finished by cutting the carrier off at the distal end of the projecting portion and then molding another dielectric body (second insulating member) so as to fill the space where said carrier was located. In addition, as an alternative example, Patent Document 1 has also disclosed a configuration in which the notched portion of said mating body portion is sealed by a metal sheet member (second tubular portion) separate from the mating body portion.

PATENT DOCUMENTS

[Patent Document 1]
Japanese Published Patent Application No. 2019-016460

SUMMARY

Problems to be Solved

As discussed above, in the coaxial connector of Patent Document 1, adequate shielding properties cannot be achieved because a notched portion is formed in a section of the mating body portion of the outer conductor in the circumferential direction and the contact portion of the inner conductor is not surrounded at the location of said notched portion. In addition, although in the previously discussed alternative example of Patent Document 1 deterioration in shielding properties is minimized by sealing the notched portion with a metal sheet member, the step of sealing the notched portion with the metal sheet member becomes necessary when the coaxial connector is manufactured, which makes the manufacture of the coaxial connector more laborious.

In view of the aforesaid circumstances, it is an object of the present invention to provide a coaxial electrical connector capable of ensuring simple and easy manufacture and adequate shielding properties, and methods of manufacture therefor.

Technical Solution

In accordance with the invention, the above-described problem is solved through the use of a coaxial electrical connector according to a first invention as described below and methods of manufacture for a coaxial electrical connector according to a second invention and a third invention.

The coaxial electrical connector according to the first invention is a coaxial electrical connector which is connected to a circuit board and into and from which a counterpart connector is plugged and unplugged such that the direction of plugging and unplugging is an up-down direction perpendicular to the surface of said circuit board, wherein the connector comprises a metal outer conductor that has a tubular portion whose axial direction is an up-down direction, a metal inner conductor that is located in the interior space of said tubular portion, and a dielectric body that secures the outer conductor and the inner conductor in place, the inner conductor has an upright portion that extends in the up-down direction and a projecting portion that extends outwardly in the radial direction of the tubular portion from the bottom end side of said upright portion, the upright portion has an internal contact portion for contact with the counterpart connector, and the projecting portion has a connecting portion that is connected to the circuit board in the outer edge section in the radial direction.

In such a coaxial electrical connector, in the first invention, the inner conductor is surrounded by the outer conductor in the circumferential direction of the tubular portion throughout the entire circumference thereof, the entire internal contact portion and at least a portion of the projecting portion are located within the bounds of the outer conductor in the up-down direction, the dielectric body has a bottom plate portion which has its bottom face aligned with the surface of the circuit board and which secures the bottom end portion of the outer conductor and the projecting portion of the inner conductor in place, the outer edge of the connecting portion of the inner conductor in the radial direction is located inside the tubular portion of the outer conductor in the radial direction, the bottom plate portion of the dielectric body has formed therein a passage portion that extends therethrough in the up-down direction within a range that includes the outer edge of the connecting portion at least inside the tubular portion of the outer conductor, and the outer edge section of the connecting portion is positioned so as to protrude into the passage portion.

In the first invention, as discussed above, the inner conductor is surrounded by the outer conductor in the circumferential direction of the tubular portion throughout the entire circumference thereof, and the entire internal contact portion and at least a portion of the projecting portion are located within the bounds of the outer conductor in the up-down direction. Therefore, adequate shielding properties are ensured by the outer conductor. In addition, since the tubular portion of the outer conductor does not have a conventional notched portion to begin with and there is no need to additionally provide a metal sheet member for sealing said notched portion, the coaxial electrical connector can be manufactured in a simple and easy manner.

The method of manufacture for a coaxial electrical connector according to the second invention is a method of manufacture for a coaxial electrical connector which is connected to a circuit board and into and from which a counterpart connector is plugged and unplugged such that the direction of plugging and unplugging is an up-down direction perpendicular to the surface of said circuit board, wherein the connector comprises a metal outer conductor that has a tubular portion whose axial direction is an up-down direction, a metal inner conductor that is located in the interior space of said tubular portion, and a dielectric body made of dielectric material that secures the outer conductor and the inner conductor in place, the inner conductor has an upright portion that extends in the up-down direction and a projecting portion that extends outwardly in the radial direction of the tubular portion from the bottom end side of said upright portion, the upright portion has an internal contact portion for contact with the counterpart connector, and the projecting portion has a connecting portion that is connected to the circuit board in the outer edge section in the radial direction.

In such a manufacturing method, in the second invention, a carrier-equipped inner conductor, in which a carrier extends outwardly in the radial direction of the tubular portion from the outer edge of the projecting portion of the inner conductor, is secured in place in the up-down direction using a mold in a section that includes the location of the boundary between the carrier and the connecting portion, molten dielectric material is injected into the cavity of the mold and a dielectric body is molded that has a bottom plate portion extending across the surface of the circuit board and a tubular standing portion that rises upwardly from said bottom plate portion and is mounted within the tubular portion of the outer conductor, thereby securing the projecting portion of the inner conductor in place in the bottom plate portion via integral molding, a passage portion that extends in the up-down direction is formed in the bottom plate portion by extracting the mold, the carrier is cut from the connecting portion at the boundary located within the passage portion, the standing portion of the dielectric body is inserted into the tubular portion of the outer conductor, and the outer conductor is attached to the dielectric body in a state wherein the inner conductor is surrounded by the outer conductor in the circumferential direction of the tubular portion throughout the entire circumference thereof, and the entire internal contact portion and at least a portion of the projecting portion are located within the bounds of the outer conductor in the up-down direction.

In the second invention, after cutting the carrier off at the boundary between the connecting portion of the inner conductor and the carrier within the passage portion of the dielectric body, the outer conductor is attached to the dielectric body in a state wherein the standing portion of the dielectric body is inserted into the tubular portion of the outer conductor. That is, when the carrier is cut off, the standing portion of the dielectric body is not yet attached to the tubular portion of the outer conductor. Therefore, when the carrier is cut off, the carrier can be cut off in a simple and easy manner without the jig used for carrier removal interfering with the tubular portion of the outer conductor.

In addition, in a finished coaxial connector according to the second invention, in the same manner as in the first invention discussed above, the inner conductor is surrounded by the outer conductor in the circumferential direction of the tubular portion throughout the entire circumference thereof and the entire internal contact portion and at least a portion of the projecting portion are located within the bounds of the outer conductor in the up-down direction. Therefore, adequate shielding properties are ensured by the outer conductor. In addition, since there is no need to additionally provide a metal sheet member for sealing the notched portion of the outer conductor as was the case in the prior art, the coaxial electrical connector can be manufactured in a simple and easy manner.

In the second invention, the outer conductor may be attached to the dielectric body by mounting the standing portion of the dielectric body into the tubular portion of the outer conductor by press-fitting. In addition, the outer conductor may be attached to the dielectric body by crimping the tubular portion of the outer conductor while the standing portion of the dielectric body is inserted into said tubular portion.

The method of manufacture for a coaxial electrical connector according to the third invention is a method of manufacture for a coaxial electrical connector which is connected to a circuit board and into and from which a counterpart connector is plugged and unplugged such that the direction of plugging and unplugging is an up-down direction perpendicular to the surface of said circuit board, wherein the connector comprises a metal outer conductor that has a tubular portion whose axial direction is an up-down direction, a metal inner conductor that is located in the interior space of said tubular portion, and a dielectric body made of dielectric material that secures the outer conductor and the inner conductor in place, the inner conductor has an upright portion that extends in the up-down direction and a projecting portion that extends outwardly in the radial direction of the tubular portion from the bottom end side of said upright portion, the upright portion has an internal contact portion for contact with the counterpart connector, and the projecting portion has a connecting portion that is connected to the circuit board in the outer edge section in the radial direction.

In such a manufacturing method, in the third invention, the carrier-equipped inner conductor having a section bent in a crank-like configuration is disposed in the interior space of the outer conductor such that the carrier extends outwardly in the radial direction of the tubular portion from the outer edge of the projecting portion of the inner conductor in the radial direction and said carrier is located underneath the bottom end of said tubular portion at the location of said tubular portion in the radial direction, thereby producing a state in which the inner conductor is surrounded by the outer conductor in the circumferential direction of the tubular portion throughout the entire circumference thereof and the entire internal contact portion and at least a portion of the projecting portion are located within the bounds of the outer conductor in the up-down direction, the carrier-equipped inner conductor is secured in place in the up-down direction using a mold in a section that includes the boundary between the connecting portion and the carrier located within the bounds of the tubular portion, molten dielectric material is injected into the cavity of the mold, and a dielectric body having a bottom plate portion extending across the surface of the circuit board is molded, thereby securing the bottom end portion of the outer conductor and the projecting portion of the inner conductor in place in the bottom plate portion via integral molding, a passage portion that extends in the up-down direction within the bounds of the tubular portion is formed in the bottom plate portion by extracting the mold, the carrier is cut from the connecting portion at the boundary located within the passage portion.

Since the carrier of the carrier-equipped inner conductor in the third invention has a section bent in a crank-like configuration, before molding the dielectric body, the carrier-equipped inner conductor can be disposed in the interior space of the outer conductor without the carrier interfering with the outer conductor. In addition, in the third invention, the passage portion that extends in the up-down direction within the bounds of the tubular portion is formed in the bottom plate portion of the dielectric body, and the carrier is adapted to be cut off at the boundary between the connecting portion and the carrier located within the passage portion. Therefore, even though the inner conductor is covered by said tubular portion throughout the entire circumference of the tubular portion, if the jig used for carrier removal is installed from above or from below and the boundary section is severed during connector manufacture, the carrier can be cut off without said jig interfering with the tubular portion.

In addition, in a finished coaxial connector according to the third invention, adequate shielding properties are achieved in the same manner as in the previously discussed first and second inventions because the inner conductor is surrounded by the outer conductor in the circumferential direction of the tubular portion throughout the entire circumference thereof and the entire internal contact portion and at least a portion of the projecting portion of the inner conductor are located within the bounds of the outer conductor in the up-down direction. In addition, since there is no need to additionally provide a metal sheet member for sealing the notched portion of the outer conductor as was the case in the prior art, the coaxial electrical connector can be simply and easily manufactured in the same manner as in the first and second inventions.

Technical Effect

In the inventive coaxial electrical connector and a coaxial electrical connector manufactured in accordance with the inventive manufacturing method, adequate shielding properties are ensured by the outer conductor because, as described above, the inner conductor is surrounded by the outer conductor in the circumferential direction of the tubular portion throughout the entire circumference thereof and, furthermore, because the entire internal contact portion and at least a portion of the projecting portion of the inner conductor are located within the bounds of the outer conductor in the up-down direction. Also, since there is no need to additionally provide a metal sheet member for sealing the notched portion of the outer conductor as was the case in the prior art, the coaxial electrical connector can be manufactured in a simple and easy manner.

BRIEF DESCRIPTION OF THE DRAWINGS

FIGS. 4(A) and 4(B) illustrates view showing the electrical connector assembly of FIG. 1 in a mated state, wherein FIG. 4(A) is an oblique view, and FIG. 4(B) is a cross-sectional view showing a cross section taken in a plane perpendicular to the connector width direction.

FIGS. 5(A) and 5(B) illustrate view showing the receptacle coaxial electrical connector of FIG. 1, wherein FIG. 5(A) is a plan view, and FIG. 5(B) is a bottom view.

FIGS. 6(A) to 6(C) illustrate cross-sectional views showing the components used in the process of manufacture of the receptacle coaxial electrical connector, wherein FIG. 6(A) shows the carrier-equipped receptacle inner conductor secured in place by the internal dielectric body, FIG. 6(B) shows the carrier-equipped receptacle outer conductor, and FIG. 6(C) shows the inner conductor of FIG. 6(A) press-fitted into the carrier-equipped receptacle outer conductor of FIG. 6(B), using cross-sections taken in a plane perpendicular to the connector width direction.

FIGS. 12(A) to 12(C) illustrate cross-sectional views showing the components used in the process of manufacture of the receptacle coaxial electrical connector according to the second embodiment, wherein FIG. 12(A) shows the arrangement of the carrier-equipped receptacle outer conductor and the carrier-equipped receptacle inner conductor, FIG. 12(B) shows a state wherein the receptacle outer conductor and the receptacle inner conductor of FIG. 12(A) are secured in place by the internal dielectric body via unitary co-molding, and FIG. 12(C) shows a finished receptacle coaxial electrical connector with the carrier cut off, using cross-sections taken in a plane perpendicular to the connector width direction.

DETAILED DESCRIPTION

Some embodiments of the present invention will be described hereinbelow by referring to the accompanying drawings.

First Embodiment

Figure 1:
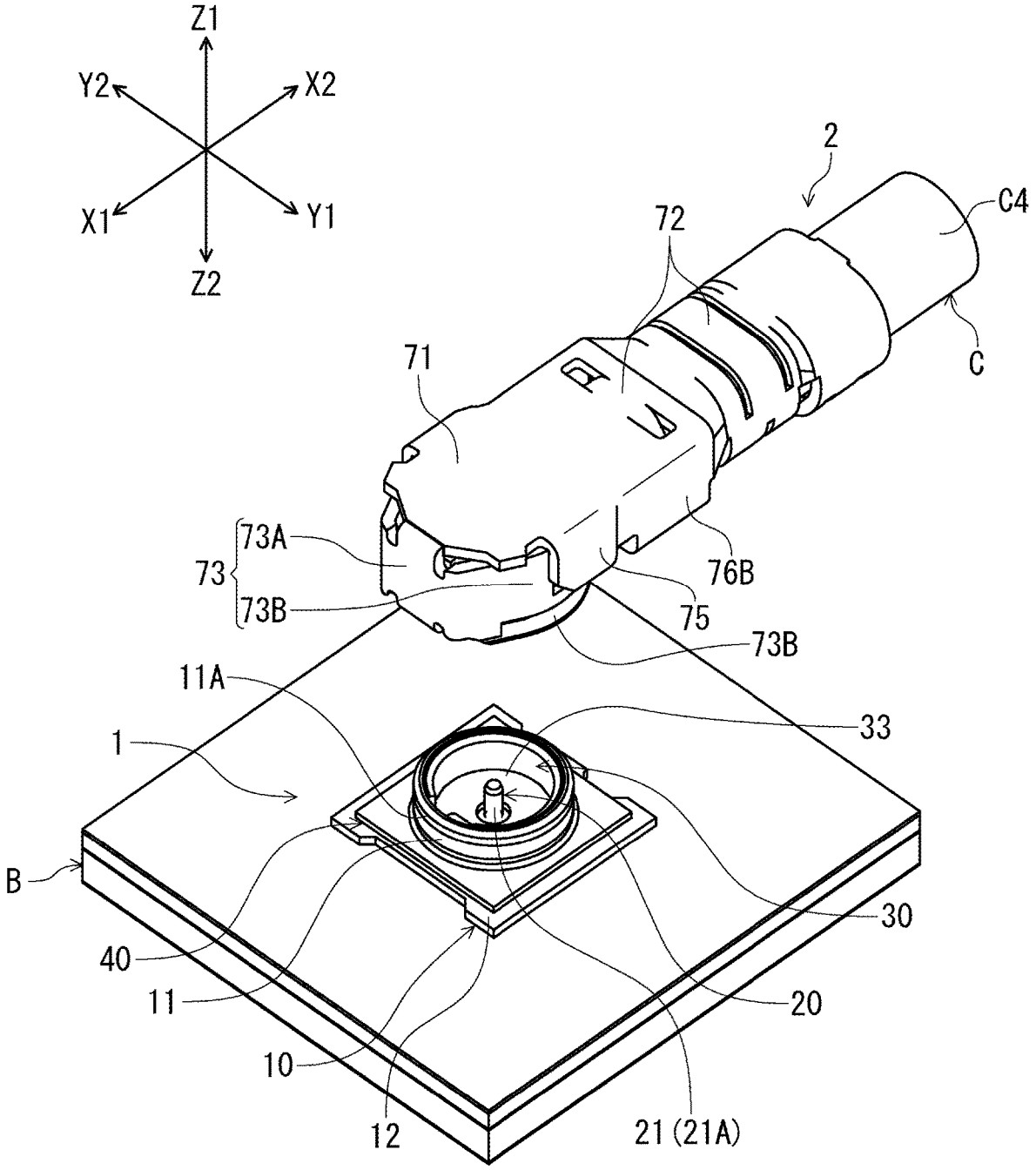
FIG. 1 illustrates an oblique view of an electrical connector assembly provided with the receptacle coaxial electrical connector and the plug coaxial electrical connector according to the first embodiment, shows a state immediately prior to connector mating.
Figure 2:
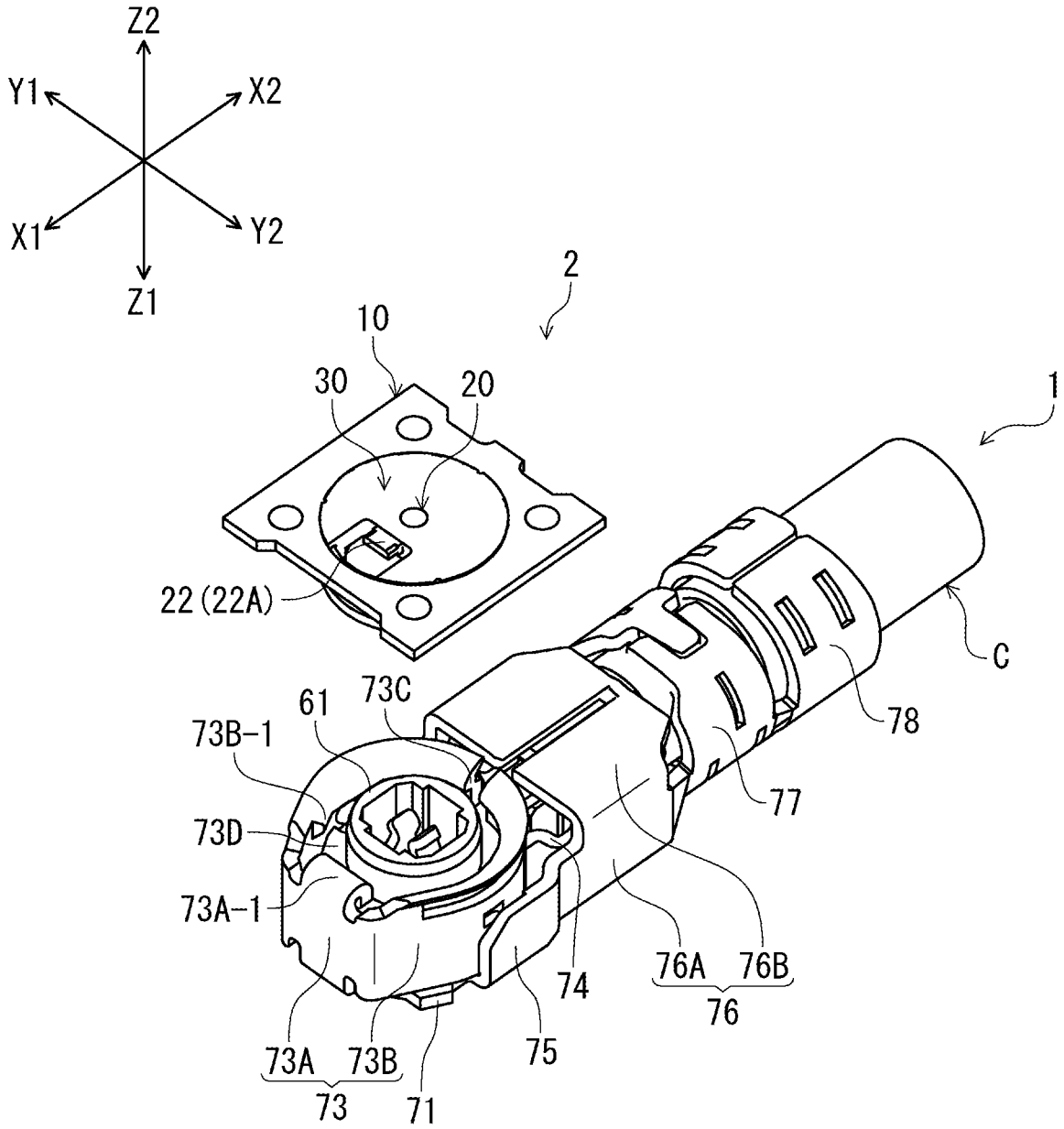
FIG. 2 illustrates an oblique view showing the electrical connector assembly of FIG. 1 in an inverted orientation.
Figure 3:
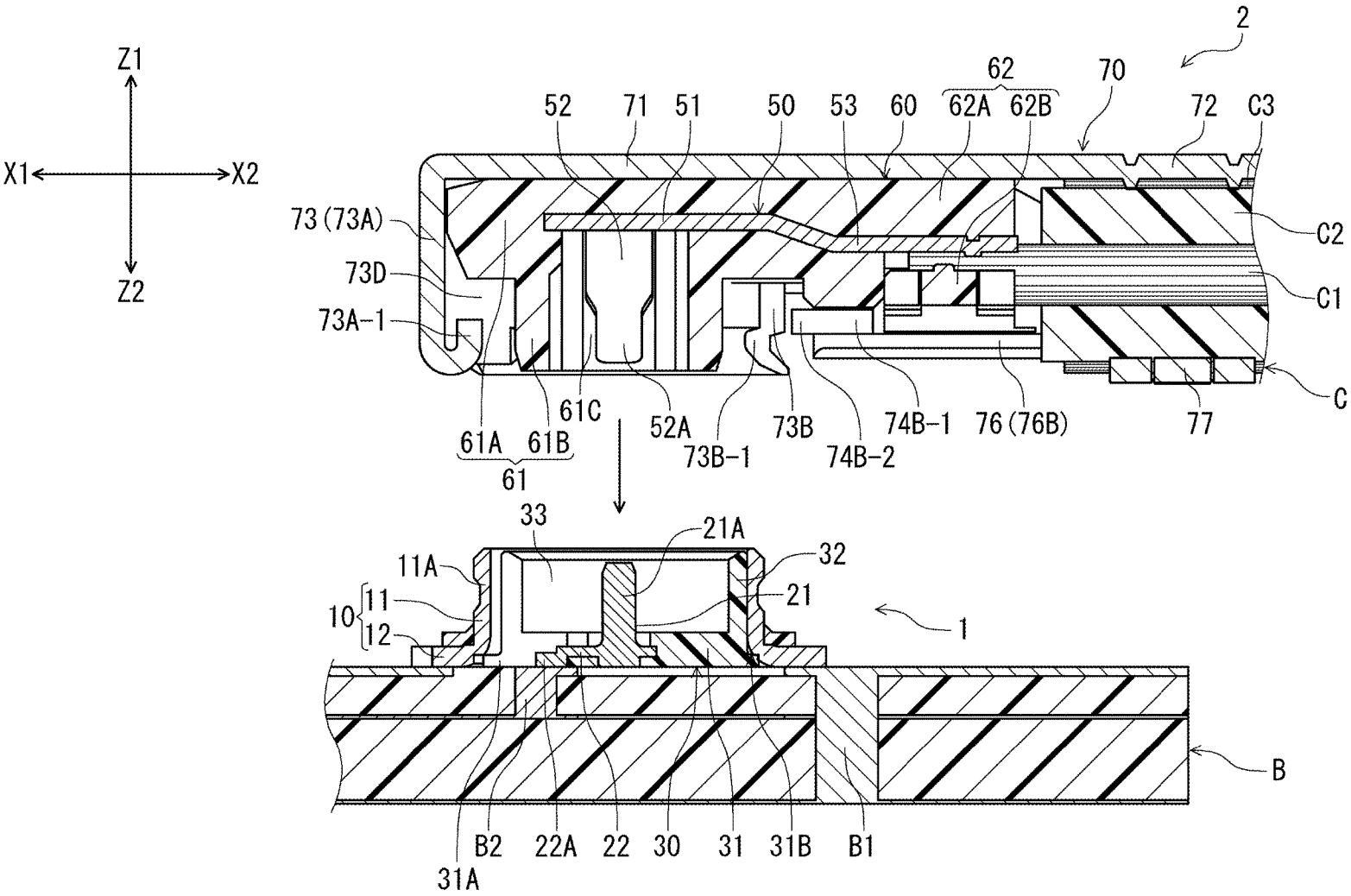
FIG. 3 illustrates A cross-sectional view showing a cross section taken in a plane perpendicular to the connector width direction of the electrical connector assembly of FIG. 1.
Figure 4A:
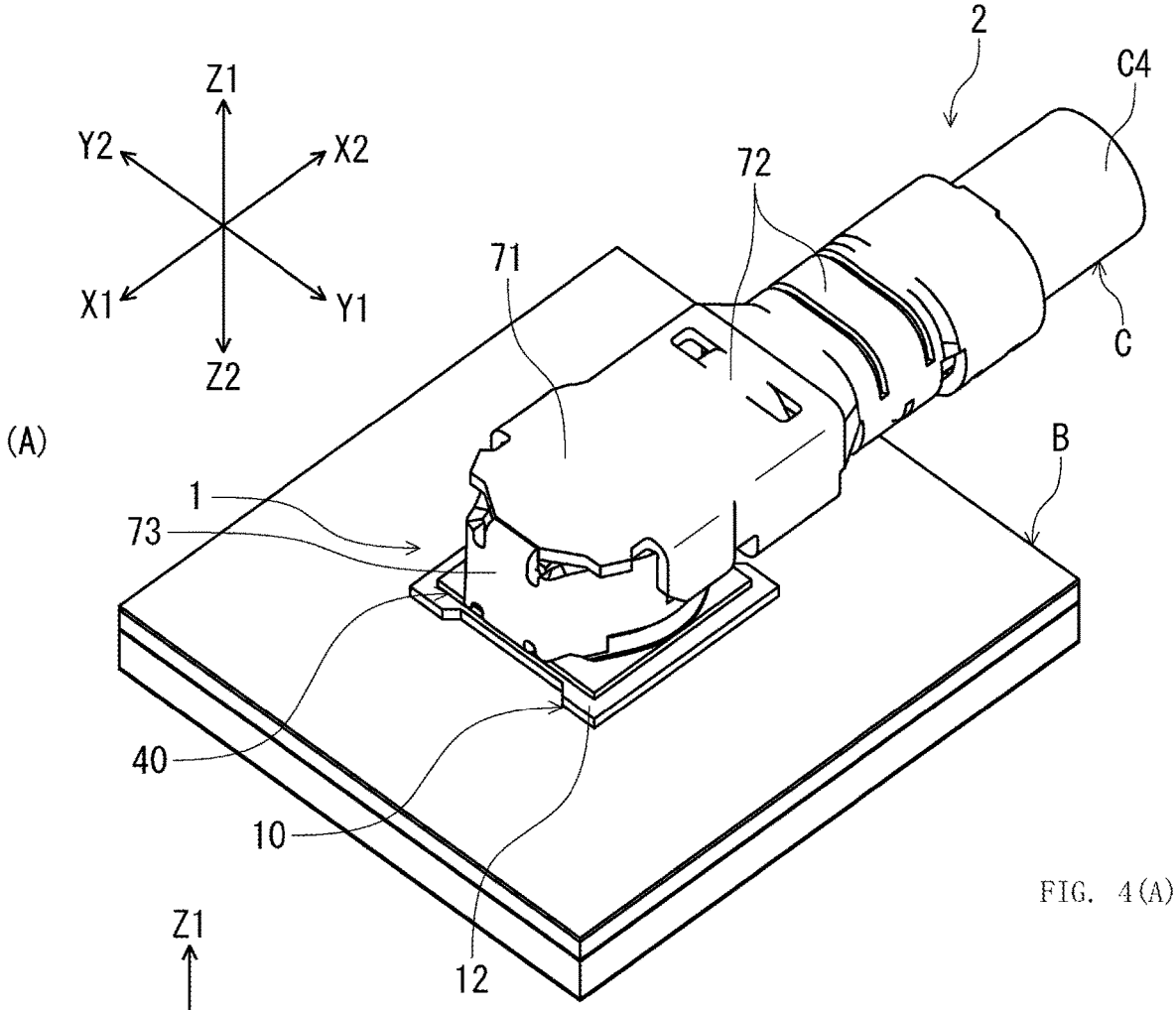
Figure 4B:
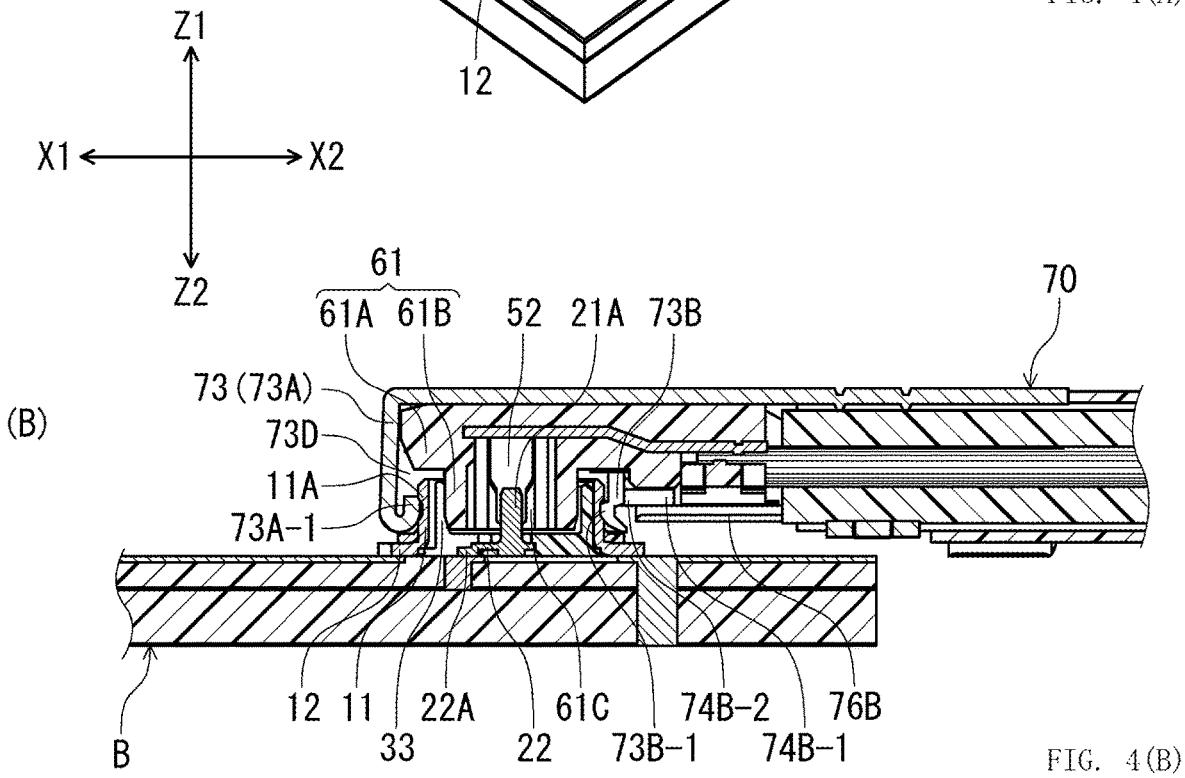

FIG. 1 is an oblique view of an electrical connector assembly provided with the receptacle coaxial electrical connector 1 (referred to as "receptacle connector 1" hereinbelow) and the plug coaxial electrical connector 2 (referred to as "plug connector 2") according to the present embodiment, and shows a state immediately prior to connector mating. FIG. 2 is an oblique view showing the electrical connector assembly of FIG. 1 in an inverted orientation. In FIG. 1, the receptacle connector 1 is shown mounted to the mounting face of a circuit board B, and in FIG. 2 circuit board B is not shown. In addition, FIG. 3 is a cross-sectional view showing a cross section taken in a plane perpendicular to the connector width direction of the electrical connector assembly of FIG. 1. FIG. 4(A) and FIG. 4(B) are views showing the electrical connector assembly of FIG. 1 in a mated state, wherein FIG. 4(A) is an oblique view, and FIG. 4(B) is a cross-sectional view showing a cross section taken in a plane perpendicular to the connector width direction.

As can be seen in FIG. 1, the receptacle connector 1 according to the present embodiment is a coaxial electrical connector which is mounted to the mounting face of circuit board B, and into and from which the plug connector 2 is plugged and unplugged such that the direction of plugging and unplugging is an up-down direction (Z-axis direction) perpendicular to said mounting face. Meanwhile, as can be seen in FIG. 1, the plug connector 2 according to the present embodiment is a coaxial electrical connector to which the front end portion (end portion on side X1 in FIG. 1) of a cable C extending in a forward-backward direction (X-axis direction), i.e., a direction parallel to the mounting face of circuit board B, is connected, and which is plugged into and unplugged from the receptacle connector 1 such that the direction of plugging and unplugging is an up-down direction. The counterpart connector for the receptacle connector 1 is the plug connector 2, and the counterpart connector for the plug connector 2 is the receptacle connector 1.

As can be seen in FIG. 1, the receptacle connector 1 includes a metal receptacle outer conductor 10 that has a tubular portion 11 whose axial direction is an up-down direction, a metal receptacle inner conductor 20 that is located in the interior space of said tubular portion 11, an internal dielectric body 30 that secures the receptacle outer conductor 10 and the receptacle inner conductor 20 in place, and an external dielectric body 40 that extends across the top face of the hereinafter-described ledge portion 12 of the receptacle outer conductor 10.

As can be seen in FIGS. 1 and 3, the receptacle outer conductor 10 is provided with the above-described tubular portion 11 and a ledge portion 12 that protrudes from the bottom end portion of said tubular portion 11 in the radial direction of said tubular portion 11. As can be seen in FIG. 3, the tubular portion 11 has a cylindrical configuration that extends in the up-down direction and is continuous in the circumferential direction of said tubular portion 11 throughout the entire circumference thereof. As can be seen in FIG. 3, the tubular portion 11 extends over a range that includes a hereinafter-described upright portion 21 of the receptacle inner conductor 20 in the up-down direction (see also FIG. 6(C)).

As can be seen in FIG. 4(B), the mating body portion 73 of the hereinafter-described plug outer conductor 70 of the plug connector 2 is adapted to be externally fitted onto the tubular portion 11 from above when the connectors are in a mated state. As can be seen in FIG. 1, FIG. 3, and FIG. 4(B), the tubular portion 11 has an external contact portion 11A that is enabled for contact with the mating body portion 73 of the plug outer conductor 70 at the top end side of said tubular portion 11. The external contact portion 11A has an annular configuration in which the exterior peripheral surface of said tubular portion 11 is recessed throughout the entire circumference of the tubular portion 11. To prevent inadvertent disengagement of the plug connector 2, the external contact portion 11A is enabled for locking by engaging the mating body portion 73 of the plug outer conductor 70 in the up-down direction with a stepped portion formed by recessing the exterior peripheral surface of the tubular portion 11 (see FIG. 4(B)).

Figure 5A:
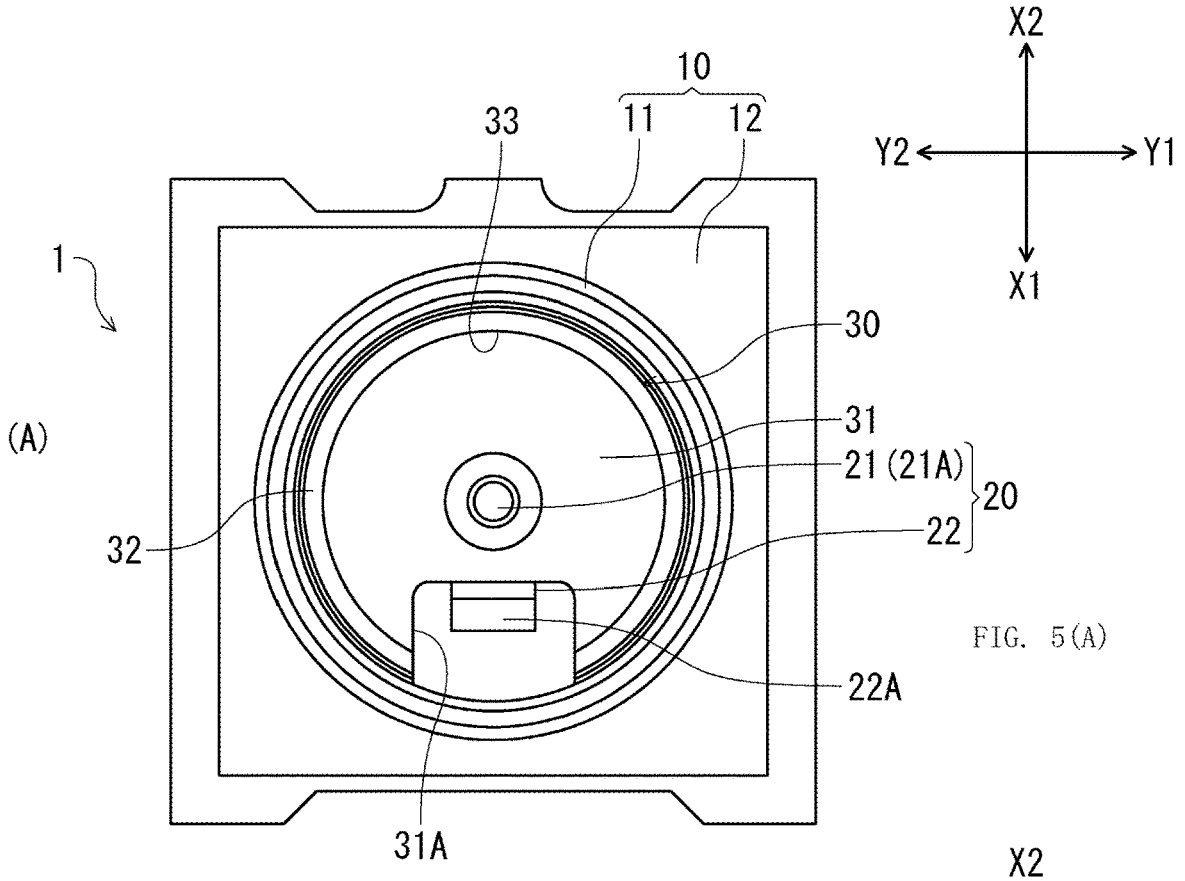

As can be seen in FIG. 1, FIG. 3, and FIG. 4(B), the ledge portion 12 extends outwardly from a perimeter edge circumscribing the entire circumference of the bottom end portion of the tubular portion 11 in the radial direction of said tubular portion 11, in other words, across the mounting face of circuit board B, and has a substantially square geometry when viewed in the up-down direction (see FIG. 5(A)). As can be seen in FIG. 3, in the up-down direction, the ledge portion 12 is located within substantially the same range as the hereinafter-described projecting portion 22 of the receptacle inner conductor 20 and, accordingly, the connecting portion 22A (see also FIG. 6(C)). In addition, the bottom face of the ledge portion 12 is level with the bottom face of the connecting portion 22A. As can be seen in FIG. 3 and FIG. 4(B), the ledge portion 12 has its bottom face solder-connected to the ground circuits B1 on the mounting face of circuit board B, thereby placing the receptacle outer conductor 10 in electrical communication with the ground circuits B1.

Figure 5B:
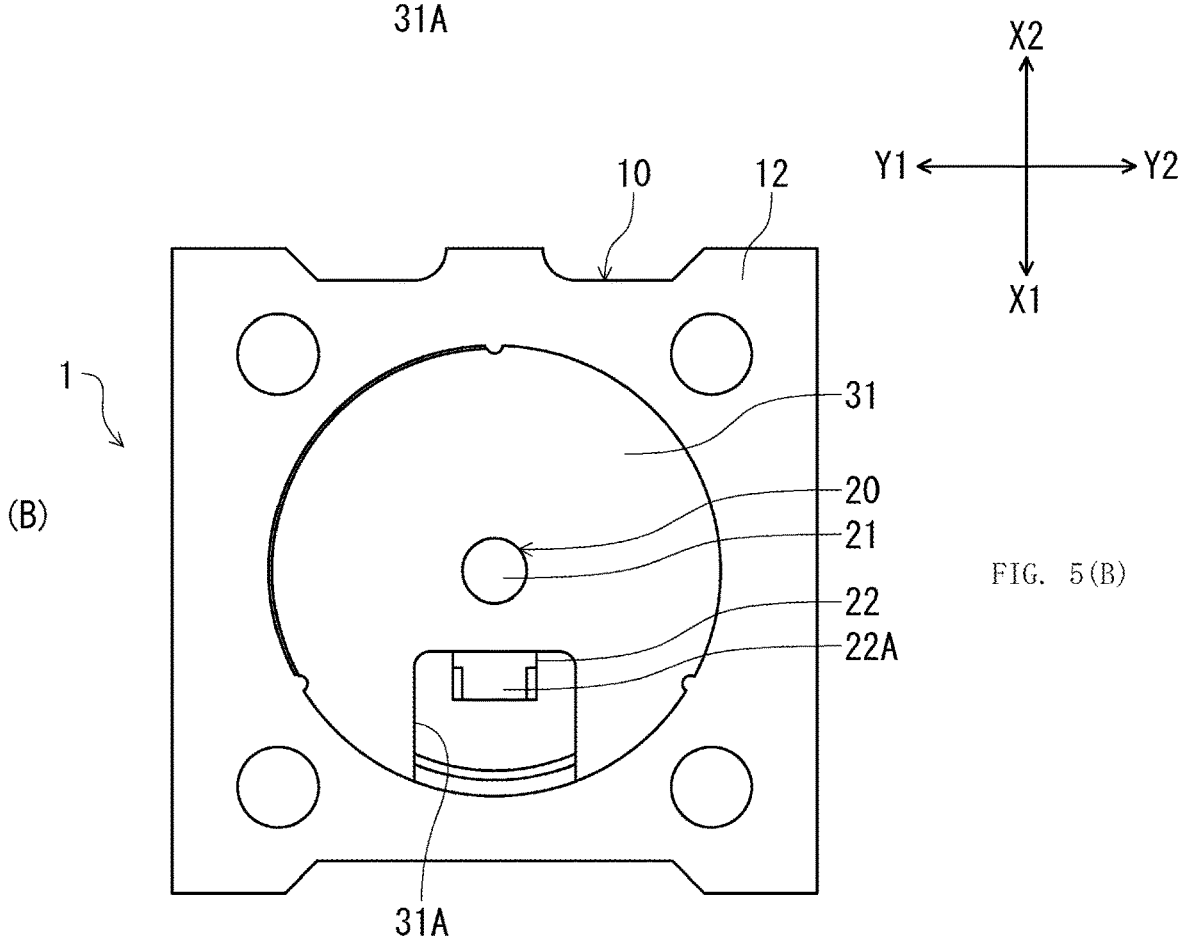

FIG. 5(A) is a plan view of the receptacle connector 1 and FIG. 5(B) is a bottom view of the receptacle connector 1. As can be seen in FIG. 3 and FIGS. 5(A) and 5(B), the receptacle inner conductor 20 has a pin-shaped upright portion 21 that extends in the up-down direction at the center location in the radial direction of the tubular portion 11 of the receptacle outer conductor 10, and a strip-shaped projecting portion 22 that extends outwardly from the bottom end section of said upright portion 21 in the radial direction of the tubular portion 11, in other words, across the mounting face of circuit board B. The upright portion 21 has formed therein a section that extends higher than the bottom plate portion 31 of the hereinafter-described internal dielectric body 30 as an internal contact portion 21A in the interior space of the tubular portion 11, and is enabled for contact with the hereinafter-described plug inner conductor 50 of the plug connector 2 through the medium of said internal contact portion 21A (see FIG. 4(B)).

In the present embodiment, the entire receptacle inner conductor 20 is surrounded by the receptacle outer conductor 10 in the circumferential direction of said tubular portion 11 throughout the entire circumference thereof. As can be seen in FIG. 3, FIG. 4(B), and FIGS. 5(A) and 5(B), the projecting portion 22 is shorter than the radius of the interior space of the tubular portion 11 in the radial direction and, furthermore, than the radius of the hereinafter-described receiving portion 33 of the internal dielectric body 30. In other words, the outer edge of the projecting portion 22, that is, the outer edge of the hereinafter-described connecting portion 22A, is located in the interior of the tubular portion 11 in the radial direction, and also in the interior of the receiving portion 33 of the internal dielectric body 30.

As can be seen in FIG. 3, the distal end section (outer edge section) of the projecting portion 22 in the radial direction is formed as a connecting portion 22A, which is located below the proximal end section coupled to the upright portion 21 and is connected to the signal circuits B2 of circuit board B. In the up-down direction, the bottom face of the connecting portion 22A is substantially level with the signal circuits B2 of the mounting face. The connecting portion 22A is solder-connected to the signal circuits B2 on the mounting face while placed in surface contact therewith, thereby bringing the receptacle inner conductor 20 in electrical communication with the signal circuits B2.

As can be seen in FIG. 3 and FIG. 4(B), the internal dielectric body 30 has a substantially disk-like bottom plate portion 31 that extends across the mounting face of circuit board B, and an upwardly open standing portion 32 that rises upward from the bottom plate portion 31 along the inner peripheral surface of the tubular portion 11 of the receptacle outer conductor 10. As can be seen in FIG. 3, in the bottom plate portion 31, the bottom face of the bottom plate portion 31 is located substantially level with the mounting face of circuit board B. In the up-down direction, the bottom plate portion 31 is formed to a thickness in a range that includes the projecting portion 22 and the bottom end portion of the upright portion 21 of the receptacle inner conductor 20, and secures the projecting portion 22 and the bottom end portion of the upright portion 21 in place via unitary co-molding.

A notch-like passage portion 31A, which is open outwardly in the radial direction and that extends in the up-down direction, is formed in the bottom plate portion 31. Therefore, when viewed in the up-down direction, the bottom plate portion 31 has an exterior configuration in which a section in the circular circumferential direction has been cut out (see FIGS. 5(A) and 5(B)). As can be seen in FIGS. 5(A) and 5(B), the passage portion 31A includes the projecting portion 22 in the circumferential direction of the tubular portion 11 and, in addition, is formed in a range extending from an intermediate location of the bottom plate portion 31 in the radial direction to the location of the outer edge (see also FIG. 3). As can be seen in FIG. 3, the outer edge portion 31B of the bottom plate portion 31 in the radial direction protrudes outward of the standing portion 32 in the radial direction and is located within the thickness of the tubular portion 11 of the receptacle outer conductor 10 directly below the tubular portion 11. In other words, the opening portion of the passage portion 31A in the radial direction is located within the thickness of the tubular portion 11 directly below the tubular portion 11. Therefore, as illustrated in FIG. 5(A), when the receptacle connector 1 is viewed from above, the passage portion 31A forms an aperture (window portion), whose opening portion is sealed by the inner peripheral surface of the tubular portion 11.

The standing portion 32 has an upwardly open cylindrical configuration. The standing portion 32, whose outer diameter is slightly larger than the inner diameter of the tubular portion 11 of the receptacle outer conductor 10, is adapted to be mounted into the tubular portion 11 by press-fitting from below. As a result of press-fitting the standing portion 32 in this manner, the internal dielectric body 30 secures the receptacle outer conductor 10 in place. The interior space of the internal dielectric body 30, that is, the space enclosed by the standing portion 32, is formed as a receiving portion 33 used for receiving the hereinafter-described small diameter portion 61B of the plug connector 2 (see FIG. 4(B)).

As shown in FIG. 1, the external dielectric body 40 extends across the top face of the ledge portion 12 of the receptacle outer conductor 10 and has a thin plate-like configuration of a substantially square geometry slightly smaller than the ledge portion 12 of the receptacle outer conductor 10 when viewed from above. The external dielectric body 40 serves to prevent inadvertent solder wicking, i.e., the spread of molten solder over a large area on the top face of the ledge portion 12 when the ledge portion 12 is solder-connected to the ground circuits B1 of circuit board B.

Figure 6A:
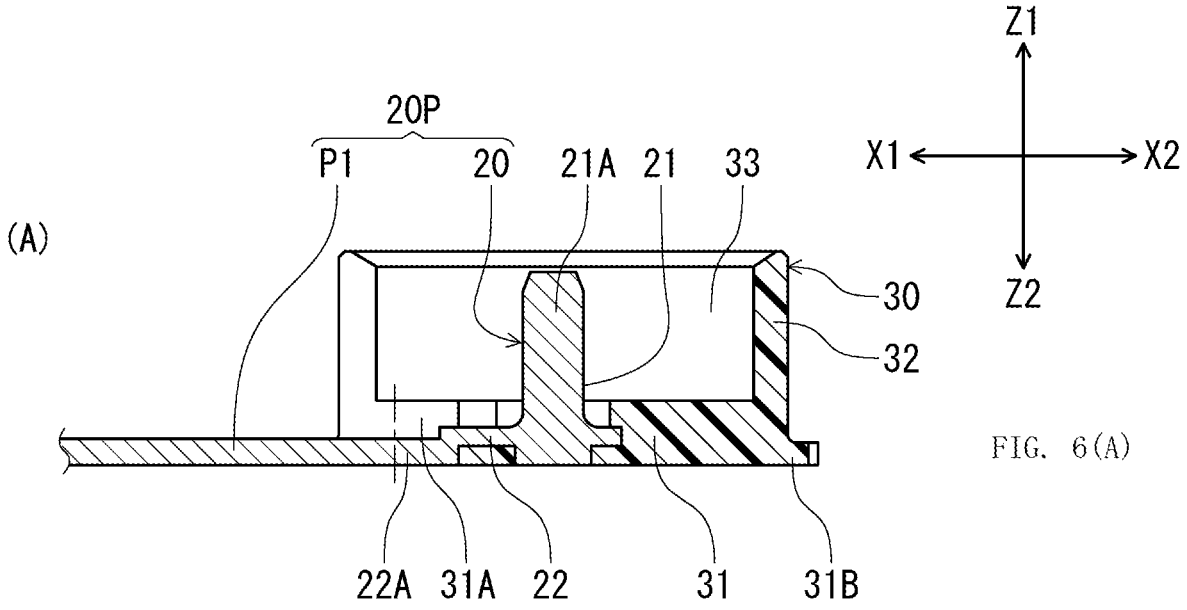
Figure 6B:
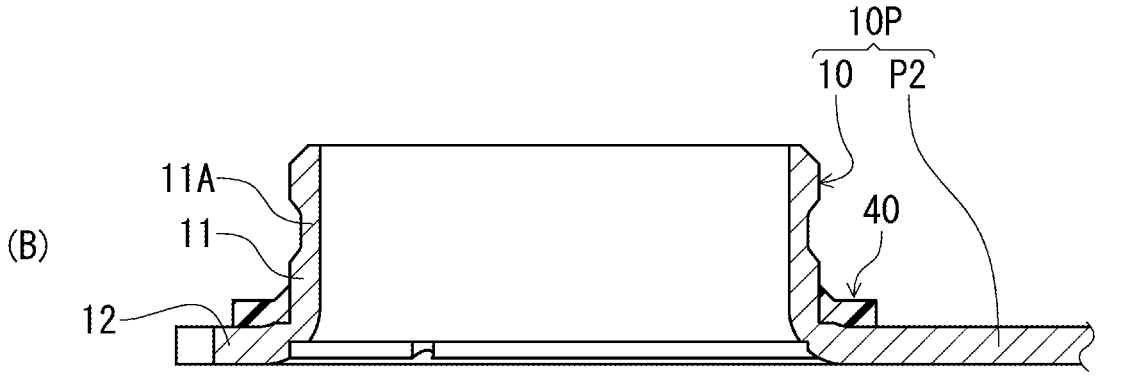
Figure 6C:
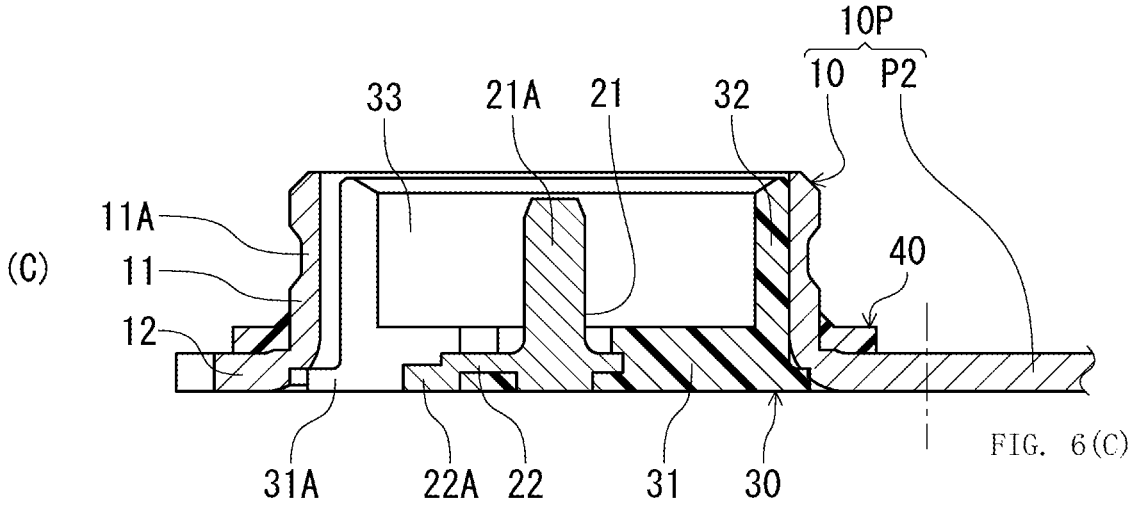

The receptacle connector 1 of the above configuration is fabricated in accordance with the following procedure. FIGS. 6(A) to 6(C) show cross-sectional views showing the components used in the process of manufacture of the receptacle connector 1, wherein FIG. 6(A) shows the carrier-equipped receptacle inner conductor secured in place by the internal dielectric body, FIG. 6(B) shows the carrier-equipped receptacle outer conductor, and FIG. 6(C) shows the receptacle inner conductor of FIG. 6(A) press-fitted into the carrier-equipped receptacle outer conductor of FIG. 6(B) using cross-sections taken in a plane perpendicular to the connector width direction.

First, a carrier-equipped inner conductor 20P, in which a strip-shaped carrier P1 extends straight outwardly in the radial direction from the outer edge (distal end) of the projecting portion 22 of the receptacle inner conductor 20 (see FIG. 6(A)), is provided, and the carrier-equipped inner conductor 20P is secured in place by clamping in a mold (not shown) in the up-down direction in a section that includes the boundary between the carrier P1 and the outer edge of the projecting portion 22, in other words, the outer edge of the connecting portion 22A (the location indicated by the one-dot chain line in FIG. 6(A)).

Next, molten dielectric material (resin material) is injected into the cavity of the mold and allowed to solidify, thereby molding the internal dielectric body 30 (see FIG. 6(A)). As a result, the projecting portion 22 and the bottom end portion of the upright portion 21 of the receptacle inner conductor 20 are secured in place via unitary co-molding with the bottom plate portion 31 of the internal dielectric body 30. Subsequently, a notch-like passage portion 31A, which is open outwardly in the radial direction and that extends in the up-down direction, is formed in the bottom plate portion 31 by extracting the mold. At such time, the section that was held in the mold, i.e., the section that includes the boundary, is located within the passage portion 31A and is not covered by the internal dielectric body 30 while not being held in place by the bottom plate portion 31. Next, the carrier P1 is cut from the connecting portion 22A at the boundary with a jig used for carrier removal (not shown). As a result, the outer edge section of the connecting portion 22A is positioned so as to protrude into the passage portion 31A (see also FIGS. 5(A) and 5(B)).

In addition, a carrier-equipped outer conductor 10P (see FIG. 6(B)), in which a carrier P2 extends from a portion of the perimeter edge of the ledge portion 12 of the receptacle outer conductor 10 in parallel to the major faces of the ledge portion 12 (faces perpendicular to the through-thickness faces), is provided, and the exterior peripheral edge portion of the ledge portion 12 is secured in place by clamping in the up-down direction in a mold (not shown). Next, molten dielectric material (resin material) is injected into the cavity of the mold to form the external dielectric body 40 extending across the top face of the ledge portion 12 (see FIG. 6(B)).

Next, as can be seen in FIG. 6(C), the standing portion 32 of the internal dielectric body 30 is mounted into the tubular portion 11 of the carrier-equipped outer conductor 10P from below by press-fitting. A jig used for carrier removal (not shown) is then used to cut the carrier P2 from the ledge portion 12 at the boundary between the perimeter edge of the ledge portion 12 and the carrier P2 (at the location indicated by the one-dot chain line in FIG. 6(C)). This completes the fabrication of the receptacle connector 1.

The receptacle connector 1 fabricated in accordance with the above procedure ensures adequate shielding properties because the receptacle outer conductor 10 surrounds the entire receptacle inner conductor 20 in the circumferential direction of the tubular portion 11 throughout the entire circumference thereof. In addition, the receptacle outer conductor 10 includes the entire internal contact portion 21A and the entire projecting portion 22 in the up-down direction, and the bottom end of the receptacle outer conductor 10 is located substantially level with the bottom face of the connecting portion 22A. In other words, when the receptacle connector 1 is disposed on the mounting face of circuit board B, the bottom end of the receptacle outer conductor 10 is in close proximity to the mounting face with little clearance therefrom, thereby further improving shielding properties. Here, it is not essential for the receptacle outer conductor 10 to include the entire projecting portion 22 in the up-down direction, and, as long as adequate shielding properties can be ensured, the receptacle outer conductor 10 may be located so as to include a portion of the projecting portion 22 in the up-down direction. In addition, the receptacle connector 1 can be manufactured in a simple and easy manner because in the present embodiment, in the first place, the tubular portion 11 of the receptacle outer conductor 10 does not have a conventional notched portion in a portion thereof in the circumferential direction, and there is no need to additionally provide a metal sheet member to seal said notched portion.

Although in the receptacle connector 1 of the present embodiment the standing portion 32 of the internal dielectric body 30 is mounted to the tubular portion 11 of the receptacle outer conductor 10 by press-fitting during the manufacturing process, the mounting process is not limited thereto. For example, mounting can be performed by providing an internal dielectric body having a standing portion with an outer diameter that is slightly smaller than the inner diameter of the tubular portion of the receptacle outer conductor, inserting said standing portion into the tubular portion from below, and crimping the tubular portion in a radial direction while maintaining this state. Based on such a mounting process, the receptacle outer conductor can also be readily attached to the dielectric body.

The configuration of the plug connector 2 will be described next. As discussed above, the plug connector 2 is a coaxial electrical connector having connected thereto the front end portion of the cable C that extends in the forward-backward direction. As can be seen in FIG. 3, the cable C is a coaxial cable in which a metal core wire C1 is disposed within a cable dielectric body C2 made of dielectric material, a shield wire C3 is provided around the periphery of said cable dielectric body C2, and, furthermore, a jacket C4 (see FIG. 1) made of dielectric material is provided around the outer periphery thereof. The shield wire C3 is exposed in the front end portion of the cable C and the core wire C1 is exposed forwardly of the shield wire C3. This exposed core wire C1 is connected to the hereinafter-described plug inner conductor 50 of the plug connector 2. In addition, as described hereinafter, in the front end portion of the cable C, the jacket C4 and the exposed shield wire C3 are tightly clamped and secured in place by the plug outer conductor 70 (see also FIG. 7).

The plug connector 2 includes a metal plug inner conductor 50 that is enabled for contact with the receptacle inner conductor 20 of the receptacle connector 1, a dielectric body 60 made of resin that secures said plug inner conductor 50 in place by unitary co-molding, and a metal plug outer conductor 70 that accommodates said dielectric body 60.

Figure 8B:
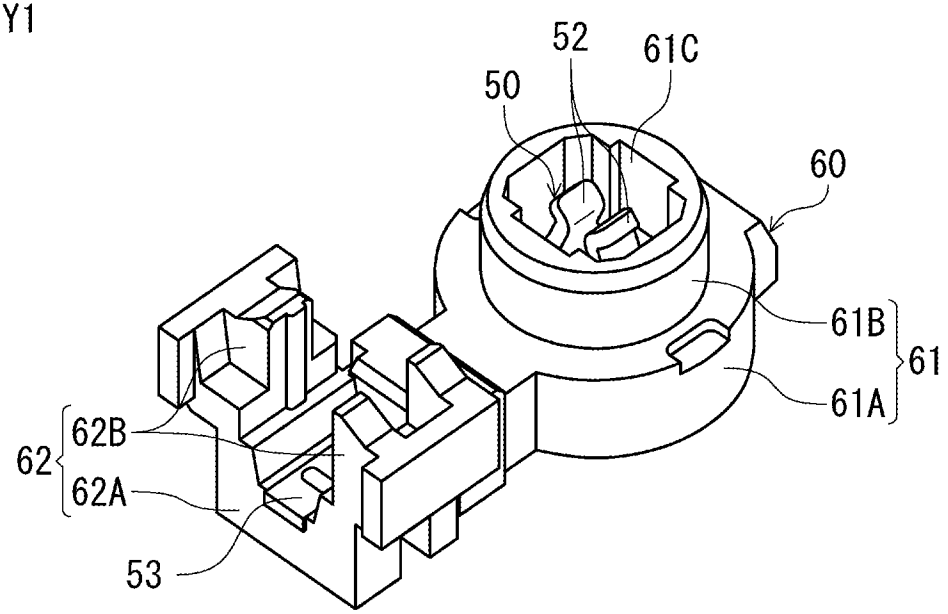
FIG. 8(B) illustrates an oblique view showing the plug inner conductor of FIG. 8(A) secured in place by the internal dielectric body.
Figure 8A:
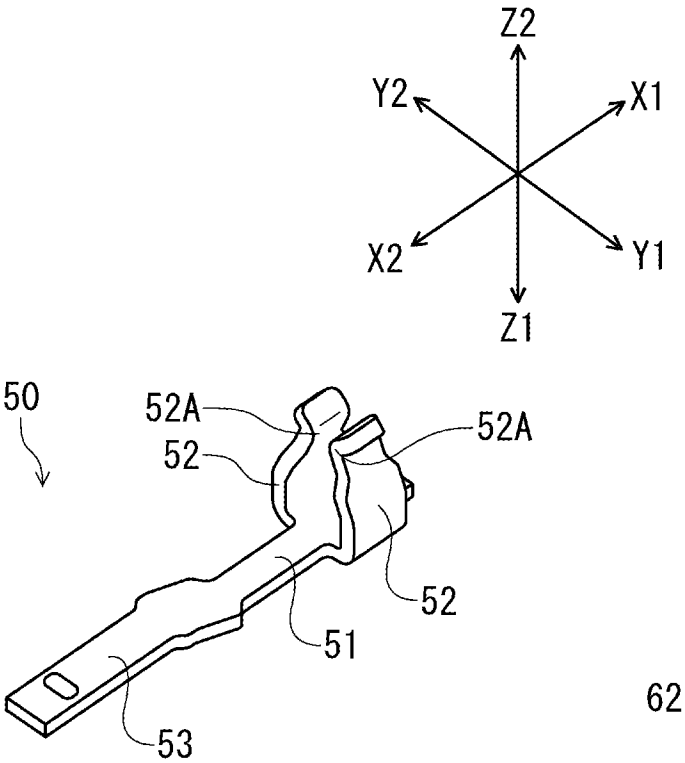
FIG. 8(A) illustrates an oblique view showing a plug inner conductor in isolation.

FIG. 8(A) is an oblique view showing the plug inner conductor 50 in isolation, and FIG. 8(B) is an oblique view showing the plug inner conductor 50 secured in place by the dielectric body 60. The plug inner conductor 50 is made by bending a metal sheet member and, as can be seen in FIG. 8(A), has a strip-shaped strip portion 51 that extends in the forward-backward direction and whose through-thickness direction is an up-down direction, a pair of internal contact portions 52 that extend upwardly (Z2 direction) from the opposite lateral edges of the front end portion of the strip portion 51, and an interconnect portion 53 that extends rearwardly (X2 direction) from the rear end of the strip portion 51 and to which the core wire C1 of the cable C is connected.

As can be seen in FIG. 8(A), the pair of internal contact portions 52 have their major faces arranged in a face-to-face relationship in the connector width direction (Y-axis direction) and are enabled for resilient displacement in the connector width direction. The pair of internal contact portions 52 have contact protrusions 52A protruding so as to approach each other on the top end side in FIG. 8(A). When the connectors are mated, the internal contact portion 21A of the receptacle inner conductor 20 is clamped by the pair of contact protrusions 52A and brought into contact with said contact protrusions 52A. The interconnect portion 53 is secured in place by the hereinafter-described base portion 62A of the dielectric body 60 (see FIG. 8(B)). As can be seen in FIG. 3, the front half of the interconnect portion 53 (section on side X1) is secured in place by embedding into the base portion 62A such that its entire peripheral surface is covered, while the rear half of the interconnect portion 53 (section on side X2) is secured in place by the base portion 62A while exposing the major face constituting its bottom face (top face in FIG. 8(B)). The core wire C1 of the cable C is connected to the exposed major face of this interconnect portion 53 by crimping (see FIG. 3). The core wire C1 may be connected to the interconnect portion 53 using solder connections.

As can be seen in FIG. 8(B), the dielectric body 60 has a bottomed cylinder-shaped stepped tubular portion 61 whose axis extends in the up-down direction, and an interconnect retaining portion 62 coupled to the rear end of the hereinafter-described large diameter portion 61A of said stepped tubular portion 61. As can be seen in FIG. 8(B), the stepped tubular portion 61 has a large diameter portion 61A, which constitutes the bottom half, and a small diameter portion 61B, which constitutes the top half and whose diameter is smaller than that of the large diameter portion 61A, and the boundary section between the large diameter portion 61A and the small diameter portion 61B is formed in a stepped configuration. Along with securing the strip portion 51 of the plug inner conductor 50 in place in its bottom portion, the stepped tubular portion 61 holds the pair of internal contact portions 52 of the plug inner conductor 50 in an inner receiving portion 61C constituting the interior space of said stepped tubular portion 61 in a manner permitting resilient displacement (see also FIG. 3). As can be seen in FIG. 8(B), the inner receiving portion 61C is upwardly (Z2 direction) open and receives the internal contact portion 21A of the receptacle connector 1 in said inner receiving portion 61C, thereby enabling contact between said internal contact portion 21A and the internal contact portions 52 (see FIG. 4(B)).

The interconnect retaining portion 62 has a base portion 62A that extends rearwardly (X2 direction) from the rear end of the large diameter portion 61A, and pressure contact portions 62B that are coupled to the top portions of the respective opposite lateral edges of said base portion 62A. The base portion 62A secures the interconnect portion 53 of the plug inner conductor 50 in place. The pressure contact portions 62B are enabled for displacement so as to inwardly collapse in the connector width direction about the locations of coupling to the base portion 62A as fulcrums, and, as described hereinafter, are adapted to secure the junction section between the interconnect portion 53 of the plug inner conductor 50 and the core wire C1 of the cable C in place by applying pressure from above in FIG. 8(B) (see also FIG. 3).

The plug outer conductor 70 is fabricated by bending a metal sheet member. As can be seen in FIGS. 1 to 3, the plug outer conductor 70 has a cover portion 71 that extends across the bottom face (top face in FIG. 1) of the stepped tubular portion 61 of the dielectric body 60, a backplate portion 72 that extends rearwardly (X2 direction) from the cover portion 71, a mating body portion 73 that surrounds the stepped tubular portion 61 of the dielectric body 60 about an axis extending in the up-down direction, arm-shaped portions 74 that are coupled to the rear end of the mating body portion 73, front lateral plate portions 75 that extend downwardly in FIG. 1 (Z2 direction) from the opposite lateral edges of the cover portion 71 opposed in the connector width direction, as well as cover plate portions 76, shield retaining portions 77, and cable retaining portions 78 that extend from the opposite lateral edges of the front end portion of the backplate portion 72 opposed in the connector width direction.

As can be seen in FIG. 3, the cover portion 71, which has a planar configuration with major faces perpendicular to the up-down direction (faces perpendicular to the through-thickness faces), covers the bottom face of the stepped tubular portion 61 of the dielectric body 60 (top face in FIG. 3) from above. The backplate portion 72 extends in the forward-backward direction within a range that includes the front end portion of the cable C (see FIG. 3). As can be seen in FIG. 2, which shows the plug connector 2 of FIG. 1 in a vertically inverted configuration, the mating body portion 73 has a front plate portion 73A that is bent at the front end edge of the cover portion 71 and extends upwardly in FIG. 2 (in the Z2 direction), and curved plate portions 73B (see also FIG. 7) that extend rearwardly from the respective ends of said front plate portion 73A opposed in the connector width direction (Y-axis direction) while curving along the stepped tubular portion 61 of the dielectric body 60. As can be seen in FIG. 2, the front plate portion 73A has a first external contact portion 73A-1 that extends upwardly from the top end edge of said front plate portion 73A and is then folded back downward on the rear side (see also FIG. 3). When the connectors are mated, this first external contact portion 73A-1 is enabled for contact with the external contact portion 11A of the receptacle connector 1 and is enabled for locking by engaging with the external contact portion 11A in the up-down direction (see FIG. 4(B)).

On the top end side of the curved plate portions 73B in FIG. 2, the pair of curved plate portions 73B have second external contact portions 73B-1 that protrude in the radial inward direction of the mating body portion 73 while extending in the circumferential direction of the mating body portion 73. The second external contact portions 73B-1 are enabled for contact with the external contact portion 11A of the receptacle outer conductor 10 in the radial direction and are enabled for locking by engaging with the external contact portion 11A in the up-down direction (see FIG. 4(B)). In addition, as can be seen in FIG. 2 and FIG. 7, a gap 73C is formed between the rear ends of the pair of curved plate portions 73B.

Figure 7:
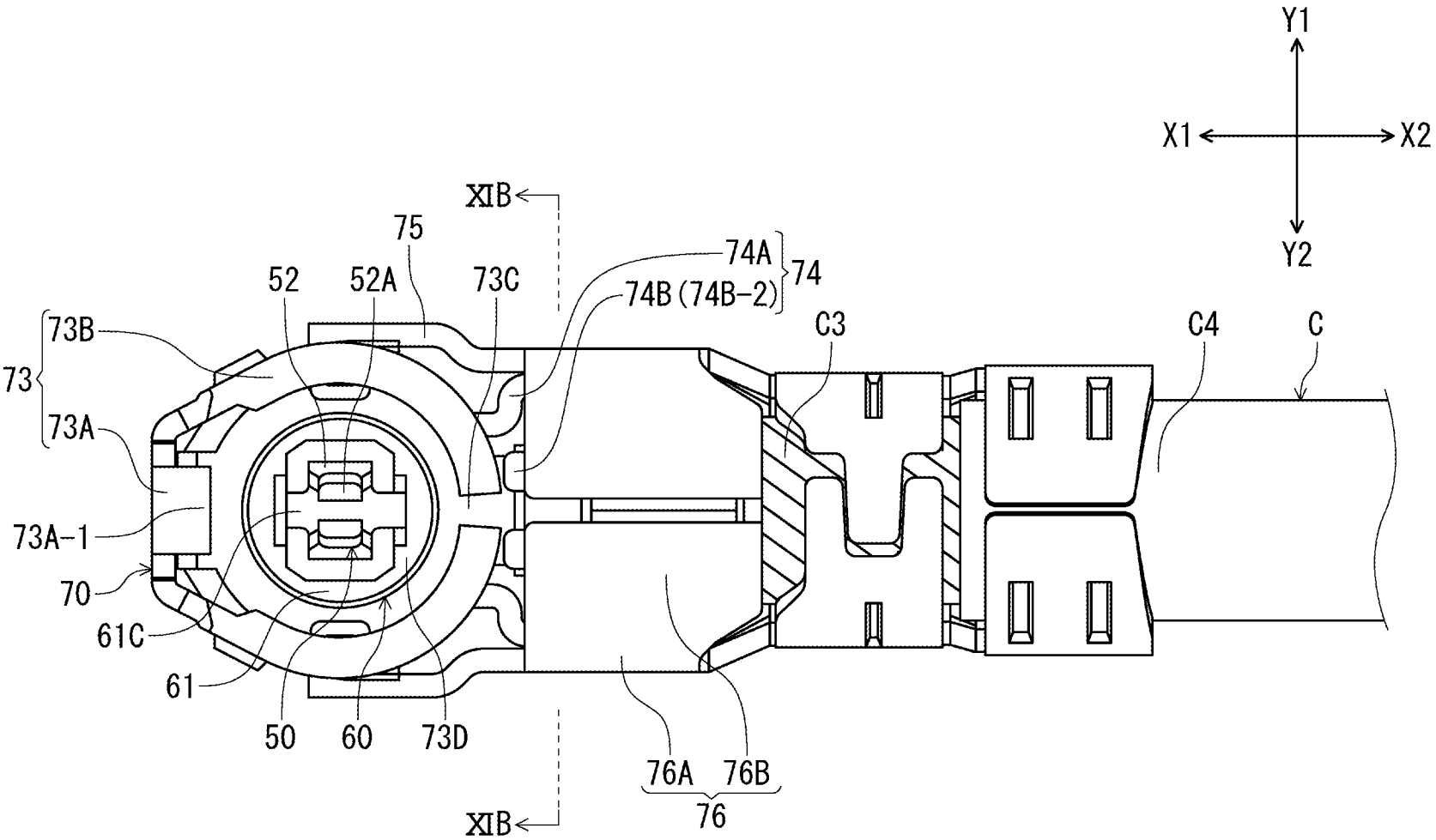
FIG. 7 illustrates a bottom view of the plug coaxial electrical connector of FIG. 1.

As can be seen in FIG. 2 and FIG. 7, the stepped tubular portion 61 of the dielectric body 60 is held within the space enclosed by the front plate portion 73A and the pair of curved plate portions 73B. The substantially annular space formed between this front plate portion 73A and the pair of curved plate portions 73B, on the one hand, and the stepped tubular portion 61, on the other hand, constitutes an external receiving portion 73D capable of receiving the tubular portion 11 of the receptacle outer conductor 10 (see also FIG. 4(B)).

Figure 9:
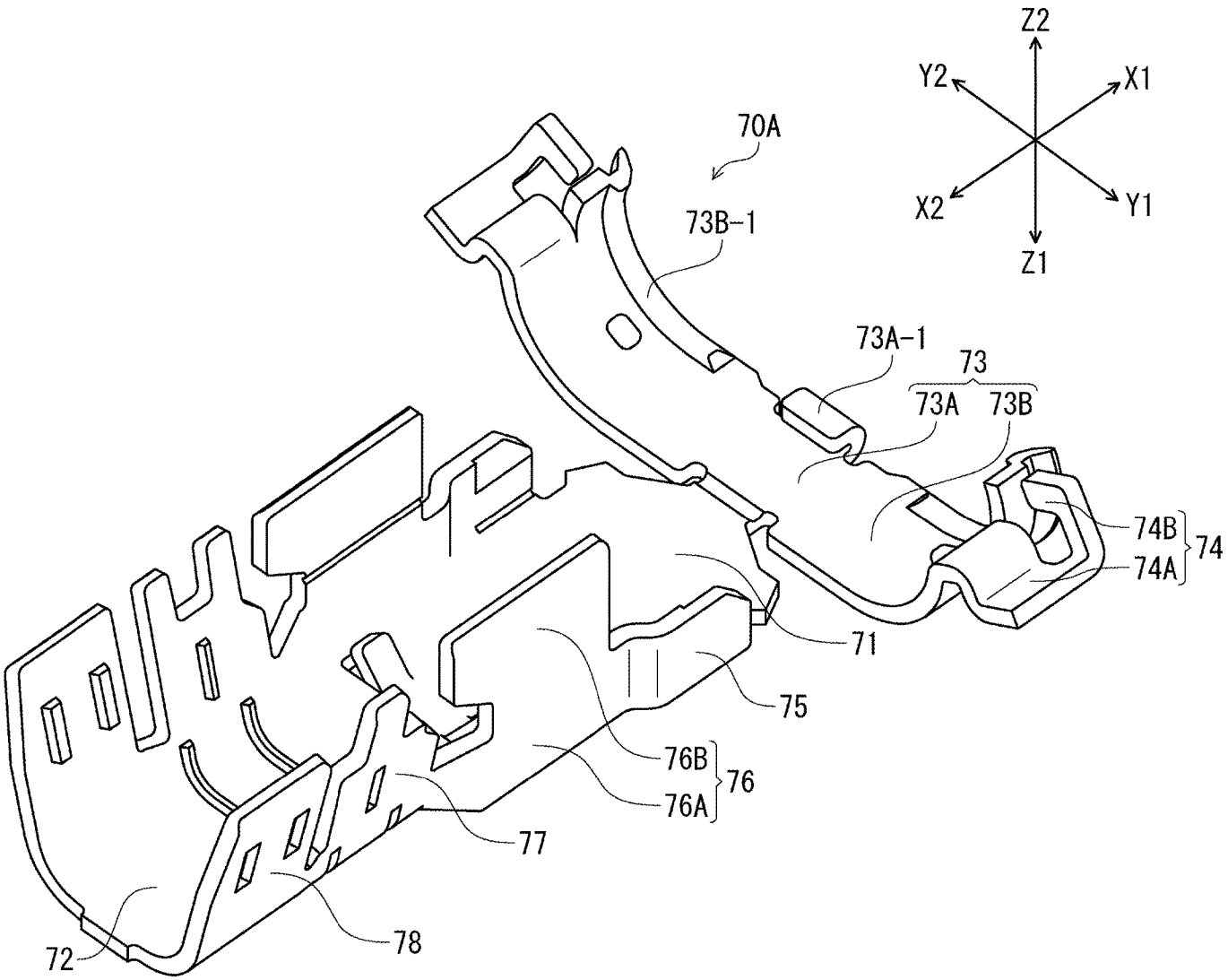
FIG. 9 illustrates an oblique view showing the first intermediate member of the plug outer conductor.
Figures 10A, 10B:
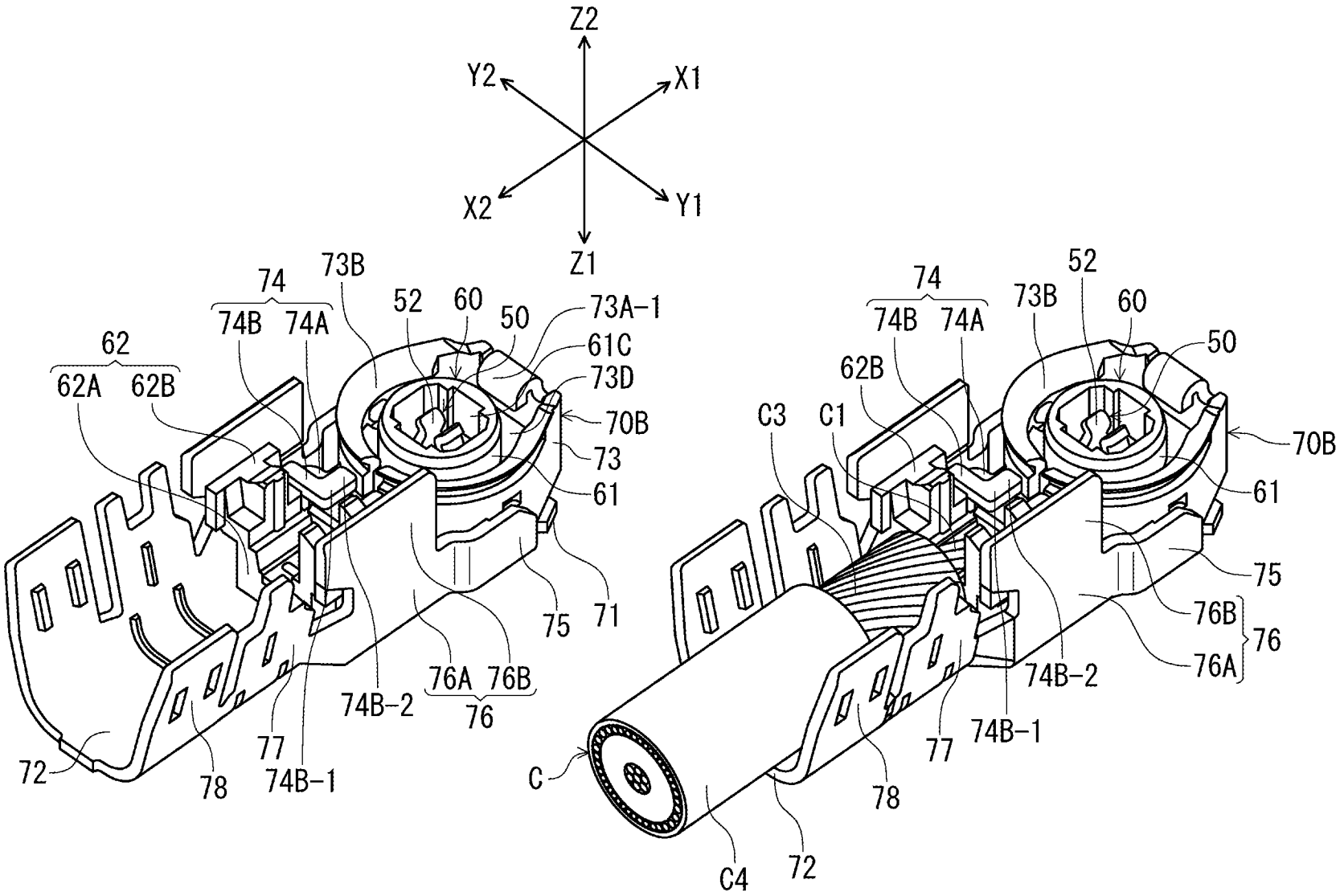
FIG. 10(A) illustrates an oblique view showing the arrangement of the internal dielectric body that secures the plug inner conductor of FIG. 8(B) in place in the second intermediate member of the plug outer conductor.
FIG. 10(B) is an oblique view showing a state in which a cable has been connected to the plug inner conductor of FIG. 10(A).

As can be seen in FIG. 7 and FIGS. 10(A) and 10(B), the arm-shaped portions 74 have base arm portions 74A that extend rearwardly from the rear end portions of the curved plate portions 73B, and resilient arm portions 74B coupled to the rear end portions of the base arm portions 74A inwardly of the base arm portion 74A in the connector width direction (see also FIG. 9). As can be seen in FIGS. 10(A) and 10(B), the resilient arm portions 74B have an L-shaped configuration when viewed in the up-down direction and have rear contact portions 74B-1 that are bent at the top edges of the rear end portions of the base arm portions 74A and extend inwardly in the connector width direction, and front contact portions 74B-2 that extend forwardly from the inner end portions of the rear contact portions 74B-1 in the connector width direction. In other words, along with having said front contact portions 74B-2 in the front end portion thereof, the resilient arm portions 74B have rear contact portions 74B-1 located in the rear end portions located rearwardly of the front contact portions 74B-2.

As can be seen in FIG. 3, the rear contact portions 74B-1 are enabled for contact with the hereinafter-described end plate portions 76B of the cover plate portions 76 through the medium of their bottom faces (top faces in FIGS. 10(A) and 10(B)). In addition, as described hereinafter, when the connectors are in a mated state, the front contact portions 74B-2, through the medium of their front end faces (through-thickness faces), are enabled for contact with the exterior peripheral surface of the rear end portions of the curved plate portions 73B (see FIG. 4(B)). The resilient arm portions 74B are enabled for resilient displacement in the up-down direction (Z-axis direction) and in the forward-backward direction (Y-axis direction). Due to the fact that the resilient arm portions 74B are enabled for resilient displacement in the up-down direction, the rear contact portions 74B-1 can contact the end plate portions 76B with adequate contact pressure. In addition, due to the fact that the resilient arm portions 74B are enabled for resilient displacement in the forward-backward direction, the front contact portions 74B-2 can contact the rear end portions of the curved plate portions 73B with adequate contact pressure.

Since in the present embodiment, as can be seen in FIG. 7, the front contact portions 74B-2 of the resilient arm portions 74B of the arm-shaped portions 74 are adapted to be located between the cover plate portions 76 and the mating body portion 73 in the forward-backward direction, the gap that was conventionally formed between the mating body portion 73 and the cover plate portions 76 is covered by the front contact portions 74B-2, thereby achieving enhanced shielding properties.

The front lateral plate portions 75 have major faces perpendicular to the connector width direction and, as can be seen in FIG. 7, oppose the exterior peripheral surface of the curved plate portions 73B of the mating body portion 73 at a location outward of the mating body portion 73 in the connector width direction. As can be seen in FIG. 1 and FIG. 2, the front lateral plate portions 75 are coupled to the front ends of the hereinafter-described rear lateral plate portions 76A of the cover plate portions 76.

The cover plate portions 76 are located rearwardly of the mating body portion 73, with a gap left between them and said mating body portion 73 (see FIG. 7). The cover plate portions 76 are located within a range that includes the junction section of the interconnect portion 53 of the plug inner conductor 50 and the core wire C1 of the cable C in the forward-backward direction and ensures shielding properties by covering said junction section. As can be seen in FIG. 2, the cover plate portions 76 have rear lateral plate portions 76A that have major faces perpendicular to the connector width direction, and end plate portions 76B that are bent at the top edges of the rear lateral plate portions 76A and have major faces that extend inwardly in the connector width direction and are perpendicular to the up-down direction. The end plate portions 76B push the pressure contact portions 62B of the dielectric body 60 toward the junction section such that said pressure contact portions 62B are displaced and collapse inwardly in the connector width direction, thereby firmly securing the junction section in place with said pressure contact portions 62B.

The shield retaining portions 77 are located rearward of the cover plate portions 76 within a range that includes part of the exposed shield wire C3 of the cable C. As a result of crimping against this exposed shield wire C3, the shield retaining portions 77 secure said shield wire C3 in place and, at the same time, create a state permitting electrical communication with said shield wire C3.

The cable retaining portions 78 are located rearward of the shield retaining portions 77 within a range that includes the front end portion of the jacket C4 of the cable C. As a result of crimping against the front end portion of the jacket C4, the cable retaining portions 78 secure said cable C in place.

The plug connector 2 of the above configuration is fabricated in accordance with the following procedure. First, the plug inner conductor 50 illustrated in FIG. 8(A) is placed in a mold (not shown) and molten dielectric material (resin material) is injected into the cavity of the mold and allowed to solidify, thereby molding a dielectric body 60. As a result, as can be seen in FIG. 8(B), the plug inner conductor 50 is secured in place by the dielectric body 60 via unitary co-molding. Specifically, the strip portion 51 of the plug inner conductor 50 is secured in place by the large diameter portion 61A of the dielectric body 60 and the interconnect portion 53 of the plug inner conductor 50 is secured in place by the base portion 62A of the dielectric body 60 (see also FIG. 3).

Next, before the plug outer conductor 70 is formed by bending, a metal sheet member is prepared. The metal sheet member is bent at right angles at locations corresponding to the opposed lateral edge portions of the backplate portion 72 and the cover portion 71 (edge portions extending in the forward-backward direction) to form a first intermediate member 70A such as the one illustrated in FIG. 9. Next, the dielectric body 60 is placed on the first intermediate member 70A. At such time, the dielectric body 60 is disposed such that the stepped tubular portion 61 of the dielectric body 60 is located above the cover portion 71 of the first intermediate member 70A, and the interconnect retaining portion 62 is located above the front half of the backplate portion 72. Furthermore, the mating body portion 73 and the arm-shaped portions 74 are formed by bending the front end section of the first intermediate member 70A, thereby forming a second intermediate member 70B such as the one illustrated in FIG. 10(A). As a result, the stepped tubular portion 61 of the dielectric body 60 is held within the mating body portion 73. In addition, an annular external receiving portion 73D is formed between the inner peripheral surface of the mating body portion 73 and the exterior peripheral surface of the stepped tubular portion 61.

Next, as can be seen in FIG. 10(B), the front end portion of the cable C is disposed on the backplate portion 72. At such time, the core wire C1 exposed in the front end portion of the cable C is disposed on the exposed major face of the rear half of the interconnect portion 53 of the plug inner conductor 50 (see FIG. 3). Subsequently, the core wire C1 is solder-connected to the interconnect portion 53. Next, as can be seen in FIG. 11(A), the cover plate portions 76, shield retaining portions 77, and cable retaining portions 78 are formed by partially bending the plug outer conductor 70. As a result, the end plate portions 76B of the cover plate portions 76 push the pressure contact portions 62B of the dielectric body 60 toward the junction section, and the junction section is firmly secured in place by the pressure contact portions 62B (see FIG. 3).

Figure 11B:
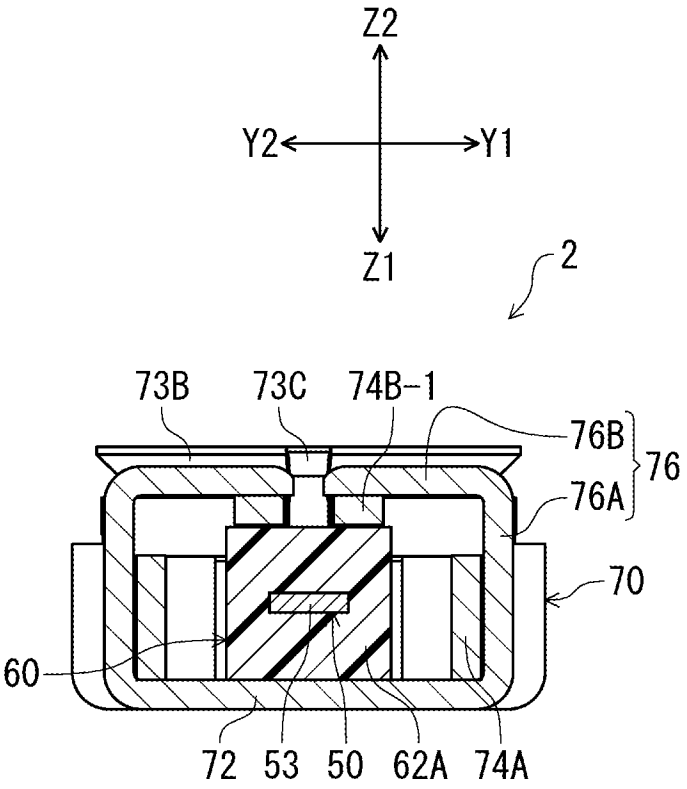
FIG. 11(B) is an XIB-XIB cross-sectional view of the plug coaxial electrical connector of FIG. 7.
Figure 11A:
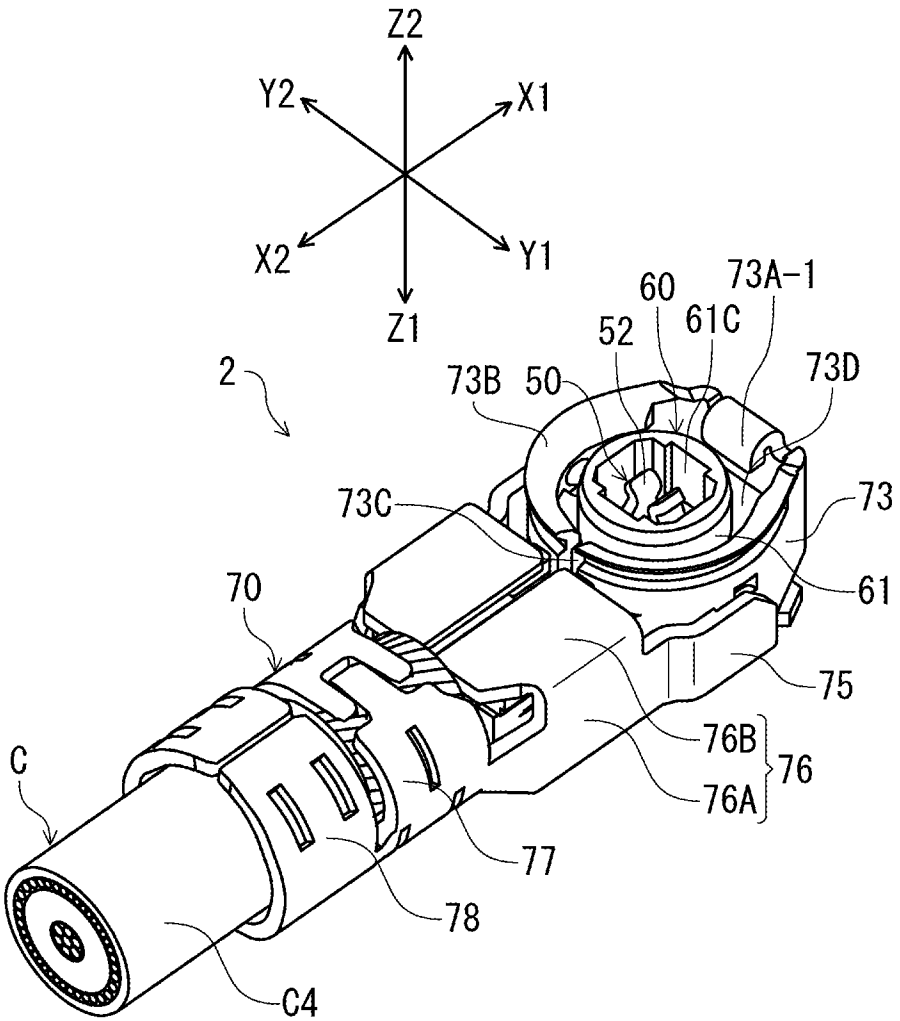
FIG. 11(A) illustrates an oblique view of a plug coaxial electrical connector finished by bending a portion of the second intermediate member of FIG. 10(B)

In addition, as can be seen in FIG. 11(B), which is an XIB-XIB cross-sectional view of FIG. 7, the bottom faces (major faces) of the end plate portions 76B are placed in contact with the top faces (major faces) of the rear contact portions 74B-1 of the arm-shaped portions 74 under contact pressure to create a state permitting electrical communication. Furthermore, as can be seen in FIG. 11(A), the shield retaining portions 77 are crimped against the exposed shield wire C3 to thereby secure said shield wire C3 in place and, at the same time, create a state permitting electrical communication with said shield wire C3. In addition, the cable retaining portion 78 are crimped against the front end portion of the jacket C4 to secure said cable C in place. This completes the manufacture of the plug connector 2.

The receptacle connector 1 and the plug connector 2 of the above configuration are matingly connected in accordance with the following procedure. First, as can be seen in FIG. 1 and FIG. 3, the receptacle connector 1 is disposed on the mounting face of circuit board B, and, as can be seen in FIG. 3, the connecting portion 22A of the receptacle inner conductor 20 is solder-connected to the signal circuits B2 while the ledge portion 12 of the receptacle outer conductor 10 is solder-connected to the ground circuits B1, thereby mounting the receptacle connector 1 to circuit board B. Next, as can be seen in FIG. 1 and FIG. 3, the receptacle connector 1 is positioned in an orientation wherein the receiving portion 33 is upwardly open while the plug connector 2 is positioned above the receptacle connector 1 in an orientation wherein the inner receiving portion 61C (see FIG. 3) and the external receiving portion 73D (see FIG. 3) of said plug connector 2 are facing downwards.

Next, the plug connector 2 is lowered and matingly connected to the receptacle connector 1 from above. At such time, as can be seen in FIG. 4(B), the tubular portion 11 of the receptacle outer conductor 10 of the receptacle connector 1 enters the external receiving portion 73D of the plug connector 2 from below. As a result, the external contact portion 11A of the receptacle outer conductor 10, on the one hand, and the first external contact portion 73A-1 and the second external contact portions 73B-1 of the plug outer conductor 70, on the other hand, are brought into contact under contact pressure and placed in electrical communication. At such time, the external contact portion 11A is engaged with the first external contact portion 73A-1 and the second external contact portion 72A in the up-down direction and locked therewith, which prevents inadvertent decoupling of the connectors. In addition, the internal contact portion 21A of the receptacle inner conductor 20 enters between the pair of internal contact portions 52 of the plug inner conductor 50 from below, and is clamped by the contact protrusions 52A of said internal contact portions 52, thereby placing the internal contact portion 21A and the internal contact portions 52 in electrical communication. This completes the operation of mating of the connectors.

In addition, in the present embodiment, when the tubular portion 11 of the receptacle outer conductor 10 enters the external receiving portion 73D of the plug connector 2, the curved plate portions 73B of the plug connector 2 are resiliently displaced so as to expand outwardly in the radial direction of the mating body portion 73. As a result, as can be seen in FIG. 4(B), curved plate portions 73B come into contact with the front contact portions 74B-2 of the arm-shaped portions 74 of the plug outer conductor 70 under contact pressure from the front. In addition, since the rear contact portions 74B-1 of the arm-shaped portions 74 are in contact with the end plate portions 76B of the cover plate portions 76 (see FIG. 11(B)), when the connectors are in a mated state, the contact between the curved plate portions 73B and the front contact portions 74B-2 places the receptacle outer conductor 10 and the cover plate portions 76 in electrical communication through the medium of the curved plate portions 73B, front contact portions 74B-2, and rear contact portions 74B-1. As a result, a return path is formed that goes through the receptacle outer conductor 10, resilient arm portions 74B of the arm-shaped portions 74, and cover plate portions 76. Namely, in the present embodiment, when the junction section of the interconnect portion 53 of the plug inner conductor 50 and the cable C is viewed in the forward-backward direction (X-axis direction), there is a return path extending in the forward-backward direction so as to surround said junction section, as a result of which shielding properties are greatly enhanced.

Second Embodiment

Although in the first embodiment the receptacle outer conductor 10 is attached to the internal dielectric body 30 in a state in which the standing portion 32 of the internal dielectric body 30 is inserted into the tubular portion 11 of the receptacle outer conductor 10, and the receptacle outer conductor 10 is thus secured in place by said internal dielectric body 30, the form of retention is not limited thereto. In the present embodiment, the internal dielectric body secures both the receptacle outer conductor and the receptacle inner conductor in place by unitary co-molding, which it is different from the first embodiment.

Figure 12A:
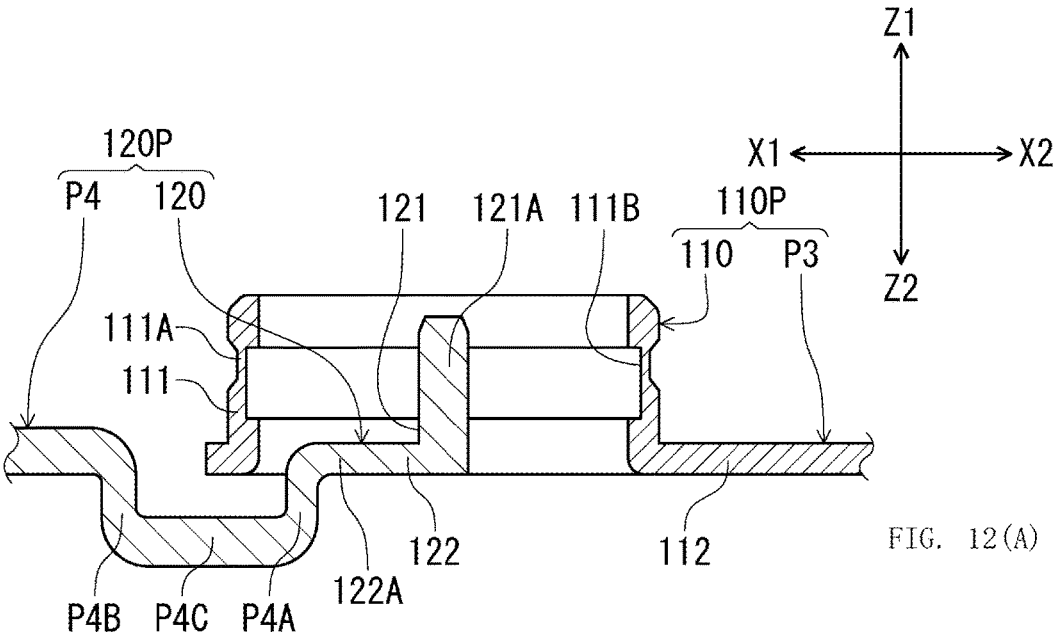
Figure 12B:
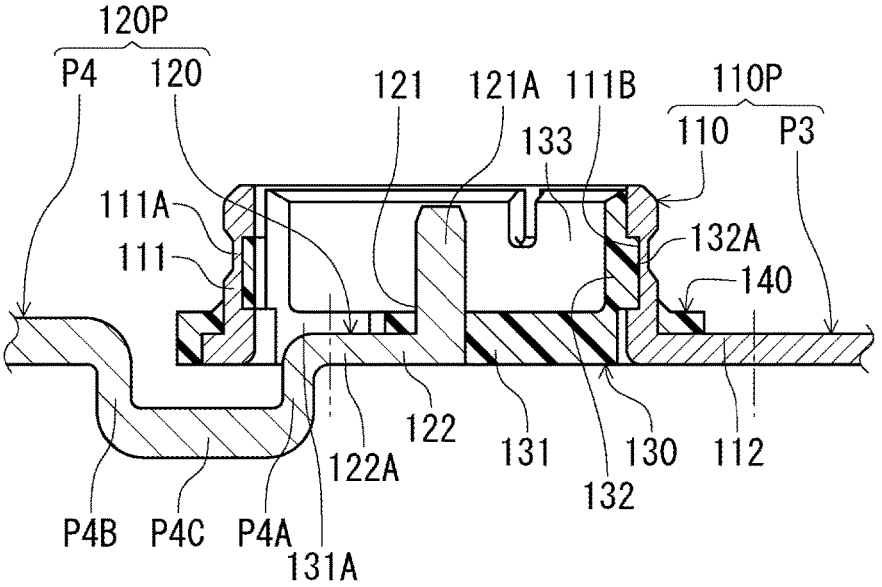
Figure 12C:
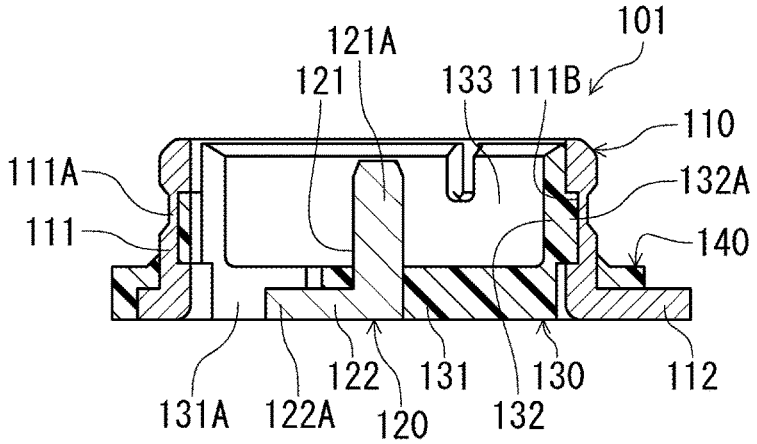

Below, the process of manufacture of the receptacle connector according to the present embodiment is described with reference to FIGS. 12(A) to 12(C). FIGS. 12(A) to 12(C) illustrate cross-sectional views that illustrates the components used in the process of manufacture of the receptacle connector 101 according to the present embodiment using cross-sections perpendicular to the connector width direction. Specifically, FIG. 12(A) shows the arrangement of a receptacle outer conductor 110P equipped with a carrier P3 (hereinafter referred to as "carrier-equipped outer conductor 110P") and a receptacle inner conductor 120P equipped with a carrier P4 (hereinafter referred to as "carrier-equipped inner conductor 120P"). FIG. 12(B) shows a state in which the carrier-equipped outer conductor 110P and the carrier-equipped inner conductor 120P of FIG. 12(A) are secured in place by the internal dielectric body 130 via unitary co-molding. FIG. 12(C) shows a finished receptacle connector 101 with the carriers P3, P4 cut off. In FIGS. 12(A) to 12(C), parts corresponding the respective components used in the first embodiment are indicated by assigning numerals obtained by adding "100" to the numerals used in the first embodiment (for example, numeral "101" is assigned to the receptacle connector).

With the exception that both the receptacle outer conductor 110 and the receptacle inner conductor 120 are secured in place by the internal dielectric body 130 via unitary co-molding, the configuration of the receptacle connector 101 of the present embodiment is substantially the same as the configuration of the receptacle connector 1 according to the first embodiment. The present embodiment will be described with emphasis on the differences from the first embodiment while omitting the description of parts common with the receptacle connector 1 of the first embodiment.

In the present embodiment, as can be seen in FIGS. 12(A) to 12(C), an engagement recess 111B, which is obtained by recessing the inner peripheral surface of the tubular portion 111 at an intermediate location in the up-down direction and that extends in the circumferential direction of said tubular portion 111 throughout the entire circumference thereof, is formed in the tubular portion 111 of the receptacle outer conductor 110. In addition, as can be seen in FIGS. 12(B) and 12(C), an engagement protrusion 132A, which protrudes from the exterior peripheral surface of the standing portion 132 at an intermediate location in the up-down direction and extends in the circumferential direction of said tubular portion 111 throughout the entire circumference thereof, is formed in the standing portion 132 of the internal dielectric body 130. As can be seen in FIG. 12 (B, C), the engagement protrusion 132A is located in the engagement recess 111B and engages said engagement recess 111B in the up-down direction, thereby preventing the internal dielectric body 130 from disengaging from the receptacle outer conductor 110.

In the present embodiment, the entire bottom face of the projecting portion 122 of the receptacle inner conductor 120 has a flat surface and can make surface contact with the mounting face of the circuit board (not shown) with its entire bottom face when disposed on said mounting face. As can be seen in FIGS. 12(A) and 12(B), the carrier P4 extends from the outer edge of the projecting portion 122 of the receptacle inner conductor 120 (outer edge of the tubular portion 111 in the radial direction) outwardly in the radial direction. The carrier P4 has an inner crank portion P4A that is bent in a crank-like configuration inwardly of the tubular portion 111 in the radial direction, and an outer crank portion P4B that is bent in a crank-like configuration outwardly of the tubular portion 111 in the radial direction. The coupling section P4C of the inner crank portion P4A and the outer crank portion P4B is located downwardly of the tubular portion 111 at the location of said tubular portion 111 in the radial direction. Therefore, even though the bottom end of the tubular portion 111 is at substantially the same location in the up-down direction as the projecting portion 122 of the receptacle inner conductor 120, there is no interference between the carrier P4 and the tubular portion 111. It is to be noted that while in the present embodiment the carrier P4 is provided with the inner crank portion P4A and the outer crank portion P4B, as an alternative, interference between carrier P4 and the tubular portion 111 can be avoided even if only the inner crank portion P4A is provided and the outer crank portion P4B is not.

The receptacle connector 101 of the present embodiment is fabricated in accordance with the following procedure. First, a carrier-equipped inner conductor 120P (see FIG. 12(A)) is prepared such that a carrier P4 extends from the outer edge of the projecting portion 122 of the receptacle inner conductor 120 (distal end). The carrier P4 extends outwardly in the radial direction from the outer edge of the projecting portion 122. In addition, a carrier-equipped outer conductor 110P (see FIG. 12(A)) is prepared such that a carrier P3 extends from a portion of the perimeter edge of the ledge portion 112 of the receptacle outer conductor 110 parallel to the major faces of said ledge portion 112 (faces perpendicular to the through-thickness faces).

Next, as can be seen in FIG. 12(A), the carrier-equipped receptacle inner conductor 120P is disposed within the interior space of the carrier-equipped outer conductor 110P. In the resultant state, the receptacle outer conductor 110 surrounds the receptacle inner conductor 120 in the circumferential direction of the tubular portion 111 throughout the entire circumference thereof and includes the entire internal contact portion 121A in the up-down direction, while the bottom end of the receptacle outer conductor 110 is located within the bounds of the connecting portion 122A. In addition, the internal contact portion 121A is located in the center of the tubular portion 111 in the radial direction.

Next, while maintaining the above-described state, a mold (not shown) is used to secure in place, in the up-down direction, the carrier-equipped inner conductor 120P in a section that includes the boundary between the connecting portion 122A and the carrier P4 located within the bounds of the tubular portion 111, and, in addition, the carrier-equipped outer conductor 110P is secured in a portion of the carrier P3. Next, molten dielectric material is injected into the cavity of the mold to form an internal dielectric body 130, and the bottom end portion of the upright portion 121 of the receptacle inner conductor 120 and the projecting portion 122 of the receptacle inner conductor 120 are secured in place in the bottom plate portion 131 of said internal dielectric body 130 via unitary co-molding (see FIG. 12(B)). In addition, the engagement protrusion 132A of the internal dielectric body 130 is formed within the engagement recess 111B of the receptacle outer conductor 110, and said engagement protrusion 132A engages the engagement recess 111B in the up-down direction. In addition, a passage portion 131A that extends in the up-down direction within the bounds of the tubular portion 111 is formed in the bottom plate portion 131 by extracting the mold (see FIG. 12(B)).

Next, the carrier P3 is cut from the ledge portion 112 of the receptacle outer conductor 110 at the boundary between the carrier P3 and the ledge portion 112 (shown with a dashed line in FIG. 12(B)) with a jig used for carrier removal (not shown). In addition, the carrier P4 is cut from the connecting portion 122A at the boundary (shown with a dashed line in FIG. 12(B)) located within the passage portion 131A with a jig used for carrier removal (not shown). At such time, the jig used for carrier removal is used from above or from below so as to avoid interference with the tubular portion 111 of the receptacle outer conductor 110. Thus, the removal of the carriers P3 and P4 completes the manufacture of the receptacle connector 101 illustrated in FIG. 12(C).

1, 101 Receptacle connectors
2 Plug connector
10, 110 Receptacle outer conductors
11, 111 Tubular portions
20, 120 Receptacle inner conductors
20P Carrier-equipped inner conductor
21, 121 Upright portions
21A, 121A Internal contact portions
22, 122 Projecting portions
22A, 122A Connecting portions
30, 130 Internal dielectric bodies
31, 131 Bottom plate portions
31A, 131A Passage portions
32, 132 Standing portions
33 Receiving portion
50 Plug inner conductor
52 Internal contact portion
60 Dielectric body
70 Plug outer conductor
73 Mating body portion
73C Gap
74 Arm-shaped portion
74A Base arm portion
45C Resilient arm portion
74B-1 Rear contact portion
74B-2 Front contact portion
76 Cover plate portion
76A Rear lateral plate portion
76B End plate portion
B Circuit board
C Cable
P1, P2, P3, P4 Carriers

What is claimed is:

1. A coaxial electrical connector which is connected to a circuit board, and into and from which a counterpart connector is plugged and unplugged such that a direction of plugging and unplugging is an up-down direction perpendicular to a surface of said circuit board, the coaxial electric connector comprising:

a metal outer conductor comprising a tubular portion whose axial direction is the up-down direction, a metal inner conductor that is located in an interior space of said tubular portion, and a dielectric body that secures the outer conductor and the inner conductor in place;

the metal inner conductor comprising an upright portion that extends in the up-down direction and a projecting portion that extends outwardly in a radial direction of the tubular portion from a bottom end side of said upright portion; and the upright portion comprising an internal contact portion for contact with the counterpart connector, and the projecting portion having a connecting portion that is connected to the circuit board in an outer edge section in the radial direction, wherein:

the inner conductor is surrounded by the outer conductor in a circumferential direction of the tubular portion throughout an entire circumference thereof, and an entire internal contact portion and at least a portion of the projecting portion are located within bounds of the outer conductor in the up-down direction;

the dielectric body comprises a bottom plate portion that has a bottom face aligned with the surface of the circuit board and secures a bottom end portion of the outer conductor and the projecting portion of the inner conductor in place;

an outer edge of the connecting portion of the inner conductor in the radial direction is located inside the tubular portion of the outer conductor in the radial direction;

the bottom plate portion of the dielectric body has formed therein a passage portion that extends therethrough in the up-down direction within a range that includes the outer edge of the connecting portion at least inside the tubular portion of the outer conductor; and the outer edge of the connecting portion is positioned so as to protrude into the passage portion.

2. A method of manufacture for a coaxial electrical connector which is connected to a circuit board, and into and from which a counterpart connector is plugged and unplugged such that a direction of plugging and unplugging is an up-down direction perpendicular to a surface of said circuit board, the coaxial electrical connector comprising a metal outer conductor comprising a tubular portion whose axial direction is the up-down direction, a metal inner conductor that is located in an interior space of said tubular portion, and a dielectric body made of dielectric material that secures the outer conductor and the inner conductor in place, the inner conductor comprising an upright portion that extends in the up-down direction and a projecting portion that extends outwardly in a radial direction of the tubular portion from a bottom end side of said upright portion; the upright portion comprising an internal contact portion for contact with the counterpart connector; and the projecting portion has a connecting portion that is connected to the circuit board in an outer edge section in the radial direction, the method comprising:

securing a carrier-equipped inner conductor, in which a carrier extends outwardly in the radial direction of the tubular portion from an outer edge of the projecting portion of the inner conductor, in place in the up-down direction using a mold in a section that includes a location of a boundary between the carrier and the connecting portion;

injecting molten dielectric material into a cavity of the mold;

molding, via integral molding, a dielectric body comprising a bottom plate portion extending across the surface of the circuit board and a tubular standing portion that rises upwardly from said bottom plate portion and is mounted within the tubular portion of the outer conductor, thereby securing the projecting portion of the inner conductor in place in the bottom plate portion;

forming a passage portion that extends in the up-down direction in the bottom plate portion by extracting the mold;

cutting the carrier from the connecting portion at a boundary located within the passage portion;

inserting the standing portion of the dielectric body into the tubular portion of the outer conductor; and attaching the outer conductor to the dielectric body such that the inner conductor is surrounded by the outer conductor in a circumferential direction of the tubular portion throughout an entire circumference thereof, and an entire internal contact portion and at least a portion of the projecting portion are located within bounds of the outer conductor in the up-down direction.

3. The method of manufacture for a coaxial electrical connector according to claim 2, wherein the attaching the outer conductor to the dielectric body is conducted by mounting the standing portion of the dielectric body into the tubular portion of the outer conductor through press-fitting.

4. The method of manufacture for a coaxial electrical connector according to claim 2, wherein the attaching the outer conductor to the dielectric body is conducted by crimping the tubular portion of the outer conductor while the standing portion of the dielectric body is inserted into said tubular portion.

5. A method of manufacture for a coaxial electrical connector which is connected to a circuit board, and into and from which a counterpart connector is plugged and unplugged such that a direction of plugging and unplugging is an up-down direction perpendicular to a surface of said circuit board, the coaxial electrical connector comprising a metal outer conductor comprising a tubular portion whose axial direction is the up-down direction, a metal inner conductor that is located in an interior space of said tubular portion, and a dielectric body made of dielectric material that secures the outer conductor and the inner conductor in place, the inner conductor comprising an upright portion that extends in the up-down direction and a projecting portion that extends outwardly in a radial direction of the tubular portion from a bottom end side of said upright portion; the upright portion comprising an internal contact portion for contact with the counterpart connector; and the projecting portion comprising a connecting portion that is connected to the circuit board in an outer edge section in a radial direction, the method comprising:

disposing a carrier-equipped inner conductor comprising a section bent in a crank-like configuration in the interior space of the outer conductor such that a carrier extends outwardly in the radial direction of the tubular portion from the outer edge of the projecting portion of the inner conductor in the radial direction and said carrier is located underneath a bottom end side of said tubular portion at a location of said tubular portion in the radial direction, thereby producing a state in which the inner conductor is surrounded by the outer conductor in a circumferential direction of the tubular portion throughout an entire circumference thereof and an entire internal contact portion and at least a portion of the projecting portion are located within bounds of the outer conductor in the up-down direction;

securing the carrier-equipped inner conductor in place in the up-down direction by using a mold in a section that includes a boundary between the connecting portion and the carrier located within bounds of the tubular portion;

injecting molten dielectric material into a cavity of the mold;

molding, via integral molding, a dielectric body having a bottom plate portion extending across the surface of the circuit board is molded, thereby securing the bottom end portion of the outer conductor and the projecting portion of the inner conductor in place in the bottom plate portion;

forming a passage portion that extends in the up-down direction within the bounds of the tubular portion in the bottom plate portion by extracting the mold; and cutting the carrier from the connecting portion at the boundary located within the passage portion.

* * * * *